US008446399B2

(12) United States Patent
Origuchi et al.

(10) Patent No.: US 8,446,399 B2
(45) Date of Patent: May 21, 2013

(54) DRIVING DEVICE AND DRIVING METHOD OF PLASMA DISPLAY PANEL, AND PLASMA DISPLAY APPARATUS

(75) Inventors: Takahiko Origuchi, Osaka (JP); Hidehiko Shoji, Osaka (JP); Hideki Nakata, Osaka (JP)

(73) Assignee: Panasonic Corporation, Osaka (JP)

( * ) Notice: Subject to any disclaimer, the term of this patent is extended or adjusted under 35 U.S.C. 154(b) by 764 days.

(21) Appl. No.: 12/674,071

(22) PCT Filed: Aug. 26, 2008

(86) PCT No.: PCT/JP2008/002307

§ 371 (c)(1),
(2), (4) Date: Feb. 18, 2010

(87) PCT Pub. No.: WO2009/031272

PCT Pub. Date: Mar. 12, 2009

(65) Prior Publication Data

US 2012/0001882 A1 Jan. 5, 2012

(30) Foreign Application Priority Data

Sep. 3, 2007 (JP) ..... 2007-228355

(51) Int. Cl.
*G09G 5/00* (2006.01)

(52) U.S. Cl.
USPC ..... 345/211; 345/208; 345/210; 345/60; 345/67; 315/169.4

(58) Field of Classification Search
USPC ..... 345/60–72, 208, 210, 211; 315/169.4
See application file for complete search history.

(56) References Cited

U.S. PATENT DOCUMENTS

2002/0126069 A1 9/2002 Kim et al.
2003/0218580 A1 11/2003 Yokoyama et al.
2005/0162344 A1 * 7/2005 Kang et al. ..... 345/60

(Continued)

FOREIGN PATENT DOCUMENTS

CN 1375809 10/2002
CN 1924968 3/2007

(Continued)

OTHER PUBLICATIONS

Japanese Office Action, mailed Apr. 3, 2012, for corresponding Japanese Patent Application.

(Continued)

*Primary Examiner* — Lun-Yi Lao
*Assistant Examiner* — Priyank Shah
(74) *Attorney, Agent, or Firm* — Greenblum & Bernstein, P.L.C.

(57) ABSTRACT

In a two-phase driving operation that is performed in at least a sub-field having a largest luminance weight, a first ramp waveform that drops from a first potential to a second potential is applied to a plurality of first scan electrodes, a second ramp waveform that drops from a third potential that is higher than the first potential to a fourth potential that is higher than the second potential is applied to a plurality of second scan electrodes in a setup period, and a scan pulse is sequentially applied to the plurality of first scan electrodes, and then a scan pulse is sequentially applied to the plurality of second scan electrodes in a write period. The two-phase driving operation is employed to prevent a discharge failure during a write discharge.

10 Claims, 17 Drawing Sheets

U.S. PATENT DOCUMENTS

| | | | | |
|---|---|---|---|---|
| 2005/0200567 | A1 | 9/2005 | Kim et al. | |
| 2006/0001600 | A1 | 1/2006 | Ito | |
| 2006/0145997 | A1 | 7/2006 | Tachibana et al. | |
| 2007/0046585 | A1* | 3/2007 | Choi | 345/68 |
| 2007/0052627 | A1 | 3/2007 | Choi | |
| 2007/0057869 | A1* | 3/2007 | Choi | 345/60 |
| 2008/0165211 | A1 | 7/2008 | Shoji et al. | |
| 2009/0021452 | A1 | 1/2009 | Takeda et al. | |
| 2009/0231317 | A1* | 9/2009 | Origuchi et al. | 345/211 |
| 2010/0039417 | A1 | 2/2010 | Maeda et al. | |
| 2010/0060627 | A1 | 3/2010 | Origuchi et al. | |
| 2010/0066718 | A1 | 3/2010 | Kuranuki et al. | |
| 2010/0066721 | A1 | 3/2010 | Origuchi et al. | |
| 2010/0066727 | A1 | 3/2010 | Maeda et al. | |
| 2010/0259521 | A1* | 10/2010 | Maeda et al. | 345/207 |
| 2010/0265219 | A1* | 10/2010 | Noguchi et al. | 345/204 |
| 2011/0109653 | A1* | 5/2011 | Origuchi et al. | 345/690 |

FOREIGN PATENT DOCUMENTS

| | | |
|---|---|---|
| CN | 1945678 | 4/2007 |
| JP | 2003-345292 | 12/2003 |
| JP | 2005-202021 | 7/2005 |
| JP | 2005-258279 | 9/2005 |
| JP | 2005-258411 | 9/2005 |
| JP | 2006-018298 | 1/2006 |
| JP | 2007-065671 | 3/2007 |
| JP | 2007-072464 | 3/2007 |
| JP | 2007-079574 | 3/2007 |
| JP | 2007-163736 | 6/2007 |
| WO | 2007/097328 | 8/2007 |

OTHER PUBLICATIONS

U.S. Appl. No. 12/671,053 to Origuchi et al., which was filed Jan. 28, 2010.

* cited by examiner

DRIVING DEVICE AND DRIVING METHOD OF PLASMA DISPLAY PANEL, AND PLASMA DISPLAY APPARATUS

TECHNICAL FIELD

The present invention relates to a driving device and a driving method of a plasma display panel, and a plasma display apparatus employing the same.

BACKGROUND ART

An AC surface discharge type panel that is typical as a plasma display panel (hereinafter abbreviated as a "panel") includes a number of discharge cells between a front plate and a back plate arranged to face each other.

The front plate is constituted by a front glass substrate, a plurality of display electrodes, a dielectric layer and a protective layer. Each display electrode is composed of a pair of scan electrode and sustain electrode. The plurality of display electrodes are formed in parallel with one another on the front glass substrate, and the dielectric layer and the protective layer are formed to cover the display electrodes.

The back plate is constituted by a back glass substrate, a plurality of data electrodes, a dielectric layer, a plurality of barrier ribs and phosphor layers. The plurality of data electrodes are formed in parallel with one another on the back glass substrate, and the dielectric layer is formed to cover the data electrodes. The plurality of barrier ribs are formed in parallel with the data electrodes, respectively, on the dielectric layer, and the phosphor layers of R (red), G (green) and B (blue) are formed on a surface of the dielectric layer and side surfaces of the barrier ribs.

The front plate and the back plate are arranged to face each other such that the display electrodes intersect with the data electrodes in three dimensions, and then sealed. An inside discharge space is filled with a discharge gas. The discharge cells are formed at respective portions at which the display electrodes and the data electrodes face one another.

In the panel having such a configuration, a gas discharge generates ultraviolet rays, which cause phosphors of R, G and B to be excited to emit light in each of the discharge cells. Accordingly, color display is performed.

A sub-field method is employed as a driving method of the panel (see Patent Document 1, for example). In the sub-field method, one field period is divided into a plurality of sub-fields, and the discharge cells are caused to emit light or not in the respective sub-fields, so that gray scale display is performed. Each sub-field has a setup period, a write period and a sustain period.

In the setup period, a setup pulse is applied to each scan electrode, and a setup discharge is performed in each discharge cell. This causes wall charges required for a subsequent write operation to be formed in each discharge cell.

In the write period, scan pulses are sequentially applied to the scan electrodes while write pulses corresponding to image signals to be displayed are applied to the data electrodes. This selectively generates write discharges between the scan electrodes and the data electrodes, causing the wall charges to be selectively formed.

In the subsequent sustain period, sustain pulses are applied between the scan electrodes and the sustain electrodes a predetermined number of times corresponding to luminances to be displayed. Accordingly, discharges are selectively induced in the discharge cells in which the wall charges have been formed by the write discharges, causing the discharge cells to emit light. The plurality of scan electrodes are driven by a scan electrode driving circuit, the plurality of sustain electrodes are driven by a sustain electrode driving circuit, and the plurality of data electrodes are driven by a data electrode driving circuit.

[Patent Document 1] JP 2006-18298 A

DISCLOSURE OF THE INVENTION

Problems to be Solved by the Invention

As described above, the scan pulse is sequentially applied to the plurality of scan electrodes in the write period. Therefore, it takes a longer time period from application of the setup pulse to application of the scan pulse in a discharge cell, which is subjected to the application of the scan pulse relatively late, of the plurality of discharge cells.

Here, the wall charges formed in the discharge cell by the setup discharge is gradually decreased under influence of the write pulses applied to the data electrodes for generating the write discharges in other discharge cells. Therefore, in the discharge cell subjected to the application of the scan pulse relatively late, the wall charges are decreased by the time of the application of the scan pulse and the write pulse. This leads to an occurrence of a discharge failure during the write discharge.

An object of the present invention is to provide a device and a driving method of a plasma display panel in which a discharge failure during a write discharge can be prevented, and a plasma display apparatus employing the same.

Means for Solving the Problems (1) According to an aspect of the present invention, a driving device of a plasma display panel including discharge cells at intersections of a plurality of scan electrodes, a plurality of sustain electrodes and a plurality of data electrodes by a sub-field method in which one field period includes a plurality of sub-fields having respective luminance weights includes a voltage source that generates a driving voltage, and a driving circuit that performs a two-phase driving operation to the plurality of scan electrodes in at least a sub-field having a largest luminance weight of the plurality of sub-fields using the driving voltage generated by the voltage source, wherein the driving circuit applies a first ramp waveform that drops from a first potential to a second potential to a plurality of first scan electrodes of the plurality of scan electrodes and applies a second ramp waveform that drops from a third potential that is higher than the first potential to a fourth potential that is higher than the second potential to a plurality of second scan electrodes of the plurality of scan electrodes in a setup period, and sequentially applies a scan pulse to the plurality of first scan electrodes and sequentially applies a scan pulse to the plurality of second scan electrodes after the scan pulse is applied to the plurality of first scan electrodes in a write period in the two-phase driving operation.

According to the driving device of the plasma display panel, the first ramp waveform that drops from the first potential to the second potential is applied to the plurality of first scan electrodes by the two-phase driving operation of the driving circuit in the setup period of at least the sub-field having the largest luminance weight of the plurality of sub-fields. This generates weak setup discharges in the discharge cells on the first scan electrodes, decreasing the amount of wall charges in the discharge cells. As a result, the amount of the wall charges in the discharge cells on the first scan electrodes can be made suitable for a write operation.

Moreover, the second ramp waveform that drops from the third potential to the fourth potential is applied to the plurality of second scan electrodes. Here, the third potential of the second ramp waveform is higher than the first potential of the first ramp waveform, and the fourth potential of the second ramp waveform is higher than the second potential of the first ramp waveform. Therefore, the decrease of the wall charges in the discharge cells on the second scan electrodes at the time of the application of the second ramp waveform is suppressed. Accordingly, a sufficient amount of wall charges can remain in the discharge cells on the second scan electrodes at an end of the setup period.

Next, the scan pulse is sequentially applied to the plurality of first scan electrodes in the write period of at least the sub-field having the largest luminance weight. This generates the write discharges in selected discharge cells on the first scan electrodes. Furthermore, the scan pulse is sequentially applied to the plurality of second scan electrodes after the scan pulse is applied to the plurality of first scan electrodes. Accordingly, the write discharges can be generated in the selected discharge cells on the second scan electrodes.

In this case, the sufficient amount of charges remains in the discharge cells on the second scan electrodes at the end of the setup period, as described above. Therefore, the amount of the wall charges in the discharge cells on the second scan electrodes can be made suitable for the write operation at the time of the application of the scan pulse to the second scan electrodes even though the wall charges of the discharge cells on the second scan electrodes are decreased during the application of the scan pulse to the first scan electrodes. As a result, discharge failures during the write discharges can be prevented from occurring in the discharge cells on the second scan electrodes in the write period.

Here, the wall charges are easily decreased in the write period of the sub-field having the large luminance weight. Therefore, the two-phase driving operation mentioned above is performed in at least the sub-field having the largest luminance weight in the driving device of the plasma display panel. Thus, the sufficient amount of charges can reliably remain in the discharge cells on the second scan electrodes in the sub-field having the largest luminance weight.

In this case, the sufficient amount of charges can remain in the discharge cells on the second scan electrodes even though the potential of the second scan electrodes is lowered to decrease the wall charges in the discharge cells on the second scan electrodes in the write period (excluding the period where the scan pulse is applied) of the sub-field having the largest luminance weight. Accordingly, the discharge cells can be reliably lit and the drive voltage generated by the voltage source can be decreased. This reduces cost for driving the plasma display panel and improves the driving performance thereof.

(2) The driving circuit may apply a third ramp waveform that drops from a fifth potential to a sixth potential to the plurality of second scan electrodes after the scan pulse is applied to the plurality of first scan electrodes and before the scan pulse is applied to the plurality of second scan electrodes in the write period of at least the sub-field having the largest luminance weight.

In this case, the weak setup discharges are generated in the discharge cells on the second scan electrodes by the application of the third ramp waveform. This reduces the amount of the wall charges in the discharge cells on the second scan electrodes. As a result, the amount of the wall charges in the discharge cells on the second scan electrodes can be made suitable for the write operation even though the amount of the wall charges in the discharge cells on the second scan electrodes is not sufficiently decreased at the time of the application of the scan pulse to the second scan electrodes. As a result, the discharge failures can be reliably prevented from occurring in the discharge cells on the second scan electrodes in the write period.

(3) The driving circuit may perform a one-phase driving operation in which a common driving waveform is applied to the plurality of scan electrodes in a setup period of at least one sub-field, which is not at least the sub-field having the largest luminance weight, of the plurality of sub-fields.

In this case, in the setup period of at least the one sub-field, the wall charges are unlikely to be decreased in a write period as compared with those in at least the sub-field having the largest luminance weight. Therefore, the common driving waveform is applied to the plurality of scan electrodes by the one-phase driving operation of the driving circuit in the setup period of at least the one sub-field. Thus, the setup discharges can be generated in the discharges cells on the plurality of scan electrodes. This eliminates the necessity of applying the third ramp waveform in the write period of at least the one sub-field, thus ensuring a sufficient sustain period in each sub-field.

(4) The driving circuit may perform the two-phase driving operation in a sub-field having a luminance weight of not less than a first luminance weight of the plurality of sub-fields, and perform the one-phase driving operation in a sub-field having a luminance weight that is smaller than the first luminance weight.

In this case, the two-phase driving operation is performed in the sub-field having the luminance weight of not less than the first luminance weight. Therefore, the sufficient amount of charges can reliably remain in the discharge cells on the second scan electrodes even though the wall charges are decreased in the setup period of the sub-field having the large luminance weight. Since the potential of the second scan electrodes can be lowered in the write period of the sub-field having the large luminance weight, the drive voltage generated by the voltage source can be decreased. This sufficiently reduces cost for driving the plasma display panel.

In addition, the one-phase driving operation is performed in the sub-field having the luminance weight smaller than the first luminance weight, so that the sufficient sustain period can be ensured in each sub-field.

(5) The sub-field having the luminance weight of not less than the first luminance weight may be set such that selected discharge cells are not normally lit in a case where the plurality of scan electrodes are driven by the one-phase driving operation in the sub-field, and the selected discharge cells are normally lit in a case where the plurality of scan electrodes are driven by the two-phase driving operation in the sub-field.

In this case, the plurality of scan electrodes are driven by the two-phase driving operation in the sub-field in which the selected discharge cells are not normally lit in the case where the plurality of scan electrodes are driven by the one-phase driving operation. This reliably causes the selected discharge cells to be lit. The plurality of scan electrodes are driven by the one-phase driving operation in the sub-field in which the selected discharge cells are normally lit in the case where the plurality of scan electrodes are driven by the one-phase driving operation. This eliminates the necessity of applying the third ramp waveform in the write period in the sub-field, thus ensuring the sufficient sustain period in each sub-field.

(6) According to another aspect of the present invention, a driving device of a plasma display panel including discharge cells at intersections of a plurality of scan electrodes, a plurality of sustain electrodes and a plurality of data electrodes by a sub-field method in which one field period includes a plurality of sub-fields having respective luminance weights includes a voltage source that generates a driving voltage, and a driving circuit that performs a three-phase driving operation to the plurality of scan electrodes in at least a sub-field having a largest luminance weight of the plurality of sub-fields and performs a two-phase driving operation to the plurality of scan electrodes in at least one sub-field, which is not at least the sub-field having the largest luminance weight, using the driving voltage generated by the voltage source, wherein the driving circuit applies a first ramp waveform that drops from a first potential to a second potential to a plurality of first scan electrodes of the plurality of scan electrodes, applies a second ramp waveform that drops from a third potential that is higher than the first potential to a fourth potential that is higher than the second potential to a plurality of second scan electrodes of the plurality of scan electrodes in a setup period, sequentially applies a scan pulse to the plurality of first scan electrodes, applies a third ramp waveform that drops from a fifth potential to a sixth potential to the plurality of second scan electrodes after the scan pulse is applied to the plurality of first scan electrodes, and sequentially applies a scan pulse to the plurality of second scan electrodes after the third ramp waveform is applied to the plurality of second scan electrodes in a write period in the two-phase driving operation, and applies a fourth ramp waveform that drops from a seventh potential to an eighth potential to a plurality of third scan electrodes of the plurality of scan electrodes, and applies a fifth ramp waveform that drops from a ninth potential that is higher than the seventh potential to a tenth potential that is higher than the eighth potential to a plurality of fourth scan electrodes and a plurality of fifth scan electrodes of the plurality of scan electrodes in the setup period, and sequentially applies a scan pulse to the plurality of third scan electrodes, applies a sixth ramp waveform that drops from an eleventh potential to a twelfth potential to the plurality of fourth scan electrodes after the scan pulse is applied to the plurality of third scan electrodes, sequentially applies a scan pulse to the plurality of fourth scan electrodes after the sixth ramp waveform is applied to the plurality of fourth scan electrodes, applies a seventh ramp waveform that drops from a thirteenth potential to a fourteenth potential to the plurality of fifth scan electrodes after the scan pulse is applied to the plurality of fourth scan electrodes, and sequentially applies a scan pulse to the plurality of fifth scan electrodes after the seventh ramp waveform is applied to the plurality of fifth scan electrodes in the write period in the three-phase driving operation.

According to the driving device of the plasma display panel, the fourth ramp waveform that drops from the seventh potential to the eighth potential is applied to the plurality of third scan electrodes by the three-phase driving operation of the driving circuit in the setup period of at least the sub-field having the largest luminance weight of the plurality of sub-fields. This generates weak setup discharges in the discharge cells on the third scan electrodes, decreasing the amount of wall charges in the discharge cells. As a result, the amount of the wall charges in the discharge cells on the third scan electrodes can be made suitable for a write operation.

Moreover, the fifth ramp waveform that drops from the ninth potential to the tenth potential is applied to the plurality of fourth scan electrodes and the plurality of fifth scan electrodes. Here, the ninth potential of the fifth ramp waveform is higher than the seventh potential of the fourth ramp waveform, and the tenth potential of the fifth ramp waveform is higher than the eighth potential of the fourth ramp waveform. Therefore, the decrease of the wall charges in the discharge cells on the second and third scan electrodes is suppressed at the time of the application of the fifth ramp waveform. Accordingly, a sufficient amount of wall charges can remain in the discharge cells on the second and third scan electrodes at an end of the setup period.

Next, the scan pulse is sequentially applied to the plurality of third scan electrodes, the plurality of fourth scan electrodes and the plurality of fifth scan electrodes in the write period of at least the sub-field having the largest luminance weight. This generates the write discharges in the selected discharge cells on the third to fifth scan electrodes.

In this case, the sufficient amount of charges remains in the discharge cells on the fourth and fifth scan electrodes at the end of the setup period, as described above. Therefore, the amount of the wall charges in the discharge cells on the fourth and fifth scan electrodes can be made suitable for the write operation at the time of the application of the scan pulses to the fourth and fifth scan electrodes even though the wall charges of the discharge cells on the fourth and fifth scan electrodes are decreased during the application of the scan pulse to the third scan electrodes. As a result, discharge failures during the write discharges can be prevented from occurring in the discharge cells on the fourth and fifth scan electrodes in the write period.

In addition, the sixth ramp waveform is applied to the fourth scan electrodes after the scan pulse is applied to the third scan electrodes and before the scan pulse is applied to the fourth scan electrodes. Accordingly, weak setup discharges are generated in the discharge cells on the fourth scan electrodes, decreasing the amount of the wall charges in the discharge cells. In this case, the amount of the wall charges in the discharge cells on the fourth scan electrodes can be made suitable for the write operation immediately before the scan pulse is applied to the fourth scan electrodes. This reliably prevents the discharge failures during the write discharges from occurring in the discharge cells on the fourth scan electrodes.

In addition, the seventh ramp waveform is applied to the fifth scan electrodes after the scan pulse is applied to the fourth scan electrodes and before the scan pulse is applied to the fifth scan electrodes. This generates weak setup discharges in the discharge cells on the fifth scan electrodes, decreasing the amount of the wall charges in the discharge cells. In this case, the amount of the wall charges in the discharge cells on the fifth scan electrodes can be made suitable for the write operation immediately before the scan pulse is applied to the fifth scan electrodes. This reliably prevents the discharge failures during the write discharges from occurring in the discharge cells on the fifth scan electrodes.

According to the driving device of the plasma display panel, the first ramp waveform that drops from the first potential to the second potential is applied to the plurality of first scan electrodes by the two-phase driving operation of the driving circuit in the setup period of at least the one sub-field, which is not the sub-field having the largest luminance weight, of the plurality of sub-fields. This generates the weak setup discharges in the discharge cells on the first scan electrodes, and decreases the amount of the wall charges in the discharge cells. As a result, the amount of the wall charges in the discharge cells on the first scan electrodes can be made suitable for the write operation.

Moreover, the second ramp waveform that drops from the third potential to the fourth potential is applied to the plurality of second scan electrodes. Here, the third potential of the second ramp waveform is higher than the first potential of the first ramp waveform, and the fourth potential of the second ramp waveform is higher than the second potential of the first ramp waveform. Therefore, the decrease of the wall charges in the discharge cells on the second scan electrodes is suppressed at the time of the application of the second ramp waveform. Accordingly, a sufficient amount of wall charges can remain in the discharge cells on the second scan electrodes at the end of the setup period.

Next, the scan pulse is sequentially applied to the plurality of first scan electrodes and the plurality of second scan electrodes in the write period of at least the sub-field having the largest luminance weight. This generates the write discharges in the selected discharge cells on the first and second scan electrodes.

In this case, the sufficient amount of charges remains in the discharge cells on the second scan electrodes at the end of the setup period, as described above. Therefore, the amount of the wall charges in the discharge cells on the second scan electrodes can be made suitable for the write operation at the time of the application of the scan pulse to the second scan electrodes even though the wall charges of the discharge cells on the second scan electrodes are decreased during the application of the scan pulse to the first scan electrodes. As a result, discharge failures during the write discharges can be prevented from occurring in the discharge cells on the second scan electrodes in the write period.

The third ramp waveform is applied to the second scan electrodes after the scan pulse is applied to the first scan electrodes and before the scan pulse is applied to the second scan electrodes. This generates the weak setup discharges in the discharge cells on the second scan electrodes, decreasing the amount of the wall charges in the discharge cells. In this case, the amount of the wall charges in the discharge cells on the second scan electrodes can be made suitable for the write operation immediately before the scan pulse is applied to the second scan electrodes. As a result, the discharge failures during the write discharges can be reliably prevented from occurring in the discharge cells on the second scan electrodes.

Here, the wall charges are easily decreased in the write period of the sub-field having the large luminance weight. Therefore, the three-phase driving operation mentioned above is performed in at least the sub-field having the largest luminance weight in the driving device of the plasma display panel. Thus, the sufficient amount of charges can reliably remain in the discharge cells on the fourth and fifth scan electrodes in the sub-field having the largest luminance weight.

In this case, the sufficient amount of charges can remain in the discharge cells on the fourth and fifth scan electrodes even though the potentials of the fourth and fifth scan electrodes are lowered to decrease the wall charges in the discharge cells on the fourth and fifth scan electrodes in the write period (excluding the period where the scan pulses are applied) of the sub-field having the largest luminance weight. Accordingly, the discharge cells can be reliably lit and the drive voltage generated by the voltage source can be decreased. This reduces cost for driving the plasma display panel and improves the driving performance thereof.

In the three-phase driving operation, the sixth ramp waveform and the seventh ramp waveform are applied to the plurality of scan electrodes in the write period. In the two-phase driving operation, the third ramp waveform is applied to the plurality of scan electrodes in the write period. That is, for driving the plurality of scan electrodes, the two-phase driving operation needs one less ramp waveform, which is applied to the plurality of scan electrodes in the write period, than those needed in the three-phase driving operation.

Therefore, the two-phase driving operation is performed in at least the one sub-field, which is not at least the sub-field having the largest luminance weight, in the driving device of the plasma display panel. Since the number of ramp waveforms applied in the write period can be reduced, the sufficient sustain period can be ensured in each sub-field.

(7) According to still another aspect of the present invention, a driving method of a plasma display panel including discharge cells at intersections of a plurality of scan electrodes, a plurality of sustain electrodes and a plurality of data electrodes by a sub-field method in which one field period includes a plurality of sub-fields having respective luminance weights includes the step of performing a two-phase driving operation to the plurality of scan electrodes in at least a sub-field having a largest luminance weight of the plurality of sub-fields, wherein the two-phase driving operation includes the steps of applying a first ramp waveform that drops from a first potential to a second potential to a plurality of first scan electrodes of the plurality of scan electrodes and applying a second ramp waveform that drops from a third potential that is higher than the first potential to a fourth potential that is higher than the second potential to a plurality of second scan electrodes of the plurality of scan electrodes in a setup period, and sequentially applying a scan pulse to the plurality of first scan electrodes and sequentially applies a scan pulse to the plurality of second scan electrodes after the scan pulse is applied to the plurality of first scan electrodes in a write period.

According to the driving method of the plasma display panel, the first ramp waveform that drops from the first potential to the second potential is applied to the plurality of first scan electrodes by the two-phase driving operation in the setup period of at least the sub-field having the largest luminance weight of the plurality of sub-fields. This generates weak setup discharges in the discharge cells on the first scan electrodes, decreasing the amount of wall charges in the discharge cells. As a result, the amount of the wall charges in the discharge cells on the first scan electrodes can be made suitable for a write operation.

Moreover, the second ramp waveform that drops from the third potential to the fourth potential is applied to the plurality of second scan electrodes. Here, the third potential of the second ramp waveform is higher than the first potential of the first ramp waveform, and the fourth potential of the second ramp waveform is higher than the second potential of the first ramp waveform. Therefore, the decrease of the wall charges in the discharge cells on the second scan electrodes is suppressed at the time of the application of the second ramp waveform. Accordingly, a sufficient amount of wall charges can remain in the discharge cells on the second scan electrodes at an end of the setup period.

Next, the scan pulse is sequentially applied to the plurality of first scan electrodes in the write period of at least the sub-field having the largest luminance weight. This generates the write discharges in the selected discharge cells on the first scan electrodes. Furthermore, the scan pulse is sequentially applied to the plurality of second scan electrodes after the scan pulse is applied to the plurality of first scan electrodes. Accordingly, the write discharges can be generated in the selected discharge cells on the second scan electrodes.

In this case, the sufficient amount of charges remains in the discharge cells on the second scan electrodes at the end of the setup period, as described above. Therefore, the amount of the wall charges in the discharge cells on the second scan electrodes can be made suitable for the write operation at the time of the application of the scan pulse to the second scan electrodes even though the wall charges of the discharge cells on the second scan electrodes are decreased during the application of the scan pulse to the first scan electrodes. As a result, discharge failures during the write discharges can be prevented from occurring in the discharge cells on the second scan electrodes in the write period.

Here, the wall charges are easily decreased in the write period of the sub-field having the large luminance weight. Therefore, the two-phase driving operation mentioned above is performed in at least the sub-field having the largest luminance weight in the driving method of the plasma display panel. Thus, the sufficient amount of charges can reliably remain in the discharge cells on the second scan electrodes in the sub-field having the largest luminance weight.

In this case, the sufficient amount of charges can remain in the discharge cells on the second scan electrodes even though the potential of the second scan electrodes is lowered to decrease the wall charges in the discharge cells on the second scan electrodes in the write period (excluding the period where the scan pulse is applied) of the sub-field having the largest luminance weight. Accordingly, the discharge cells can be reliably lit and the drive voltage generated by the voltage source can be decreased. This reduces cost for driving the plasma display panel and improves the driving performance thereof.

(8) According to still another aspect of the present invention, a driving method of a plasma display panel including discharge cells at intersections of a plurality of scan electrodes, a plurality of sustain electrodes and a plurality of data electrodes by a subs-field method in which one field period includes a plurality of sub-fields having respective luminance weights includes the steps of performing a three-phase driving operation to the plurality of scan electrodes in at least a sub-field having a largest luminance weight of the plurality of sub-fields, and performing a two-phase driving operation to the plurality of scan electrodes in at least one sub-field, which is not at least the sub-field having the largest luminance weight, wherein the two-phase driving operation includes the steps of applying a first ramp waveform that drops from a first potential to a second potential to a plurality of first scan electrodes of the plurality of scan electrodes, applying a second ramp waveform that drops from a third potential that is higher than the first potential to a fourth potential that is higher than the second potential to a plurality of second scan electrodes of the plurality of scan electrodes in a setup period, sequentially applying a scan pulse to the plurality of first scan electrodes, applying a third ramp waveform that drops from a fifth potential to a sixth potential to the plurality of second scan electrodes after the scan pulse is applied to the plurality of first scan electrodes, and sequentially applying a scan pulse to the plurality of second scan electrodes after the third ramp waveform is applied to the plurality of second scan electrodes in a write period, and the three-phase driving operation includes the steps of applying a fourth ramp waveform that drops from a seventh potential to an eighth potential to a plurality of third scan electrodes of the plurality of scan electrodes, and applying a fifth ramp waveform that drops from a ninth potential that is higher than the seventh potential to a tenth potential that is higher than the eighth potential to a plurality of fourth scan electrodes and a plurality of fifth scan electrodes of the plurality of scan electrodes in the setup period, and sequentially applying a scan pulse to the plurality of third scan electrodes, applying a sixth ramp waveform that drops from an eleventh potential to a twelfth potential to the plurality of fourth scan electrodes after the scan pulse is applied to the plurality of third scan electrodes, sequentially applying a scan pulse to the plurality of fourth scan electrodes after the sixth ramp waveform is applied to the plurality of fourth scan electrodes, applying a seventh ramp waveform that drops from a thirteenth potential to a fourteenth potential to the plurality of fifth scan electrodes after the scan pulse is applied to the plurality of fourth scan electrodes, and sequentially applying a scan pulse to the plurality of fifth scan electrodes after the seventh ramp waveform is applied to the plurality of fifth scan electrodes in the write period.

According to the driving method of the plasma display panel, the fourth ramp waveform that drops from the seventh potential to the eighth potential is applied to the plurality of third scan electrodes by the three-phase driving operation in the setup period of at least the sub-field having the largest luminance weight of the plurality of sub-fields. This generates weak setup discharges in the discharge cells on the third scan electrodes, decreasing the amount of wall charges in the discharge cells. As a result, the amount of the wall charges in the discharge cells on the third scan electrodes can be made suitable for a write operation.

Moreover, the fifth ramp waveform that drops from the ninth potential to the tenth potential is applied to the plurality of fourth scan electrodes and the plurality of fifth scan electrodes. Here, the ninth potential of the fifth ramp waveform is higher than the seventh potential of the fourth ramp waveform, and the tenth potential of the fifth ramp waveform is higher than the eighth potential of the fourth ramp waveform. Therefore, the decrease of the wall charges in the discharge cells on the second and third scan electrodes is suppressed at the time of the application of the fifth ramp waveform. Accordingly, a sufficient amount of wall charges can remain in the discharge cells on the second and third scan electrodes at an end of the setup period.

Next, the scan pulse is sequentially applied to the plurality of third scan electrodes, the plurality of fourth scan electrodes and the plurality of fifth scan electrodes in the write period of at least the sub-field having the largest luminance weight. This generates the write discharges in the selected discharge cells on the third to fifth scan electrodes.

In this case, the sufficient amount of charges remains in the discharge cells on the fourth and fifth scan electrodes at the end of the setup period, as described above. Therefore, the amount of the wall charges in the discharge cells on the fourth and fifth scan electrodes can be made suitable for the write operation at the time of the application of the scan pulse to the fourth and fifth scan electrodes even though the wall charges of the discharge cells on the fourth and fifth scan electrodes are decreased during the application of the scan pulse to the third scan electrodes. As a result, discharge failures during the write discharges can be prevented from occurring in the discharge cells on the fourth and fifth scan electrodes in the write period.

In addition, the sixth ramp waveform is applied to the fourth scan electrodes after the scan pulse is applied to the third scan electrodes and before the scan pulse is applied to the fourth scan electrodes. Accordingly, weak setup discharges are generated in the discharge cells on the fourth scan electrodes, decreasing the amount of the wall charges in the discharge cells. In this case, the amount of the wall charges in the discharge cells on the fourth scan electrodes can be made suitable for the write operation immediately before the scan pulse is applied to the fourth scan electrodes. This reliably prevents the discharge failures during the write discharges from occurring in the discharge cells on the fourth scan electrodes.

In addition, the seventh ramp waveform is applied to the fifth scan electrodes after the scan pulse is applied to the fourth scan electrodes and before the scan pulse is applied to the fifth scan electrodes. This generates the weak setup discharges in the discharge cells on the fifth scan electrodes, decreasing the amount of the wall charges in the discharge cells. In this case, the amount of the wall charges in the discharge cells on the fifth scan electrodes can be made suitable for the write operation immediately before the scan pulse is applied to the fifth scan electrodes. This reliably prevents the discharge failures during the write discharges from occurring in the discharge cells on the fifth scan electrodes.

According to the driving method of the plasma display panel, the first ramp waveform that drops from the first potential to the second potential is applied to the plurality of first scan electrodes by the two-phase driving operation in the setup period of at least the one sub-field, which is not the sub-field having the largest luminance weight, of the plurality of sub-fields. This generates the weak setup discharges in the discharge cells on the first scan electrodes, and decreases the amount of the wall charges in the discharge cells. As a result, the amount of the wall charges in the discharge cells on the first scan electrodes can be made suitable for the write operation.

Moreover, the second ramp waveform that drops from the third potential to the fourth potential is applied to the plurality of second scan electrodes. Here, the third potential of the second ramp waveform is higher than the first potential of the first ramp waveform, and the fourth potential of the second ramp waveform is higher than the second potential of the first ramp waveform. Therefore, the decrease of the wall charges in the discharge cells on the second scan electrodes is suppressed at the time of the application of the second ramp waveform. Accordingly, a sufficient amount of wall charges can remain in the discharge cells on the second scan electrodes at the end of the setup period.

Next, the scan pulse is sequentially applied to the plurality of first scan electrodes and the plurality of second scan electrodes in the write period of at least the sub-field having the largest luminance weight. This generates the write discharges in the selected discharge cells on the first and second scan electrodes.

In this case, the sufficient amount of charges remains in the discharge cells on the second scan electrodes at the end of the setup period, as described above. Therefore, the amount of the wall charges in the discharge cells on the second scan electrodes can be made suitable for the write operation at the time of the application of the scan pulse to the second scan electrodes even though the wall charges of the discharge cells on the second scan electrodes are decreased during the application of the scan pulse to the first scan electrodes. As a result, discharge failures during the write discharges can be prevented from occurring in the discharge cells on the second scan electrodes in the write period.

The third ramp waveform is applied to the second scan electrodes after the scan pulse is applied to the first scan electrodes and before the scan pulse is applied to the second scan electrodes. This generates the weak setup discharges in the discharge cells on the second scan electrodes, decreasing the amount of the wall charges in the discharge cells. In this case, the amount of the wall charges in the discharge cells on the second scan electrodes can be made suitable for the write operation immediately before the scan pulse is applied to the second scan electrodes. As a result, the discharge failures during the write discharges can be reliably prevented from occurring in the discharge cells on the second scan electrodes.

Here, the wall charges are easily decreased in the write period of the sub-field having the large luminance weight. Therefore, the three-phase driving operation mentioned above is performed in at least the sub-field having the largest luminance weight in the driving method of the plasma display panel. Thus, the sufficient amount of charges can reliably remain in the discharge cells on the fourth and fifth scan electrodes in the sub-field having the largest luminance weight.

In this case, the sufficient amount of charges can remain in the discharge cells on the fourth and fifth scan electrodes even though the potentials of the fourth and fifth scan electrodes are lowered to decrease the wall charges in the discharge cells on the fourth and fifth scan electrodes in the write period (excluding the period where the scan pulses are applied) of the sub-field having the largest luminance weight. Accordingly, the discharge cells can be reliably lit and the drive voltage generated by the voltage source can be decreased. This reduces cost for driving the plasma display panel and improves the driving performance thereof.

In the three-phase driving operation, the two ramp waveforms are applied to the plurality of scan electrodes in the write period. In the two-phase driving operation, the one ramp waveform is applied to the plurality of scan electrodes in the write period. That is, for driving the plurality of scan electrodes, the two-phase driving operation needs less ramp discharge to be applied than those needed in the three-phase driving operation. Therefore, the two-phase driving operation is performed in at least the one sub-field, which is not at least the sub-field having the largest luminance weight, in the driving method of the plasma display panel. This causes a shorter time period to be required in at least the one sub-field. As a result, the sufficient sustain period can be ensured in each sub-field.

(9) According to still another aspect of the present invention, a plasma display panel apparatus includes a plasma display panel including discharge cells at intersections of a plurality of scan electrodes, a plurality of sustain electrodes and a plurality of data electrodes, and a driving device that drives the plasma display panel by a sub-field method in which one field period includes a plurality of sub-fields having respective luminance weights, wherein the driving device includes a voltage source that generates a driving voltage, and a driving circuit that performs a two-phase driving operation to the plurality of scan electrodes in at least a sub-field having a largest luminance weight of the plurality of sub-fields using the driving voltage generated by the voltage source, and the driving circuit applies a first ramp waveform that drops from a first potential to a second potential to a plurality of first scan electrodes of the plurality of scan electrodes and applies a second ramp waveform that drops from a third potential that is higher than the first potential to a fourth potential that is higher than the second potential to a plurality of second scan electrodes of the plurality of scan electrodes in a setup period, and sequentially applies a scan pulse to the plurality of first scan electrodes and sequentially applies a scan pulse to the plurality of second scan electrodes after the scan pulse is applied to the plurality of first scan electrodes in a write period in the two-phase driving operation.

According to the plasma display panel apparatus, the first ramp waveform that drops from the first potential to the second potential is applied to the plurality of first scan electrodes by the two-phase driving operation of the driving circuit in the setup period of at least the sub-field having the largest luminance weight of the plurality of sub-fields. This generates weak setup discharges in the discharge cells on the first scan electrodes, decreasing the amount of wall charges in the discharge cells. As a result, the amount of the wall charges in the discharge cells on the first scan electrodes can be made suitable for a write operation.

Moreover, the second ramp waveform that drops from the third potential to the fourth potential is applied to the plurality of second scan electrodes. Here, the third potential of the second ramp waveform is higher than the first potential of the first ramp waveform, and the fourth potential of the second ramp waveform is higher than the second potential of the first ramp waveform. Therefore, the decrease of the wall charges in the discharge cells on the second scan electrodes is suppressed at the time of the application of the second ramp waveform. Accordingly, a sufficient amount of wall charges can remain in the discharge cells on the second scan electrodes at an end of the setup period.

Next, the scan pulse is sequentially applied to the plurality of first scan electrodes in the write period of at least the sub-field having the largest luminance weight. This generates the write discharges in the selected discharge cells on the first scan electrodes. Furthermore, the scan pulse is sequentially applied to the plurality of second scan electrodes after the scan pulse is applied to the plurality of first scan electrodes. Accordingly, the write discharges can be generated in the selected discharge cells on the second scan electrodes.

In this case, the sufficient amount of charges remains in the discharge cells on the second scan electrodes at the end of the setup period, as described above. Therefore, the amount of the wall charges in the discharge cells on the second scan electrodes can be made suitable for the write operation at the time of the application of the scan pulse to the second scan electrodes even though the wall charges of the discharge cells on the second scan electrodes are decreased during the application of the scan pulse to the first scan electrodes. As a result, discharge failures during the write discharges can be prevented from occurring in the discharge cells on the second scan electrodes in the write period.

Here, the wall charges are easily decreased in the write period of the sub-field having the large luminance weight. Therefore, the two-phase driving operation mentioned above is performed in at least the sub-field having the largest luminance weight in the plasma display panel apparatus. Thus, the sufficient amount of charges can reliably remain in the discharge cells on the second scan electrodes in the sub-field having the largest luminance weight.

In this case, the sufficient amount of charges can remain in the discharge cells on the second scan electrodes even though the potential of the second scan electrodes is lowered to decrease the wall charges in the discharge cells on the second scan electrodes in the write period (excluding the period where the scan pulse is applied) of the sub-field having the largest luminance weight. Accordingly, the discharge cells can be reliably lit and the drive voltage generated by the voltage source can be decreased. This reduces cost for driving the plasma display panel and improves the driving performance thereof.

(10) According to still another aspect of the present invention, a plasma display panel apparatus includes a plasma display panel including discharge cells at intersections of a plurality of scan electrodes, a plurality of sustain electrodes and a plurality of data electrodes, and a driving device that drives the plasma display panel by a sub-field method in which one field period includes a plurality of sub-fields having respective luminance weights, wherein the driving device includes a voltage source that generates a driving voltage, and a driving circuit that performs a three-phase driving operation to the plurality of scan electrodes in at least a sub-field having a largest luminance weight of the plurality of sub-fields and performs a two-phase driving operation to the plurality of scan electrodes in at least one sub-field, which is not at least the sub-field having the largest luminance weight, using the driving voltage generated by the voltage source, and the driving circuit applies a first ramp waveform that drops from a first potential to a second potential to a plurality of first scan electrodes of the plurality of scan electrodes, and applies a second ramp waveform that drops from a third potential that is higher than the first potential to a fourth potential that is higher than the second potential to a plurality of second scan electrodes of the plurality of scan electrodes in a setup period, sequentially applies a scan pulse to the plurality of first scan electrodes, applies a third ramp waveform that drops from a fifth potential to a sixth potential to the plurality of second scan electrodes after the scan pulse is applied to the plurality of first scan electrodes, and sequentially applies a scan pulse to the plurality of second scan electrodes after the third ramp waveform is applied to the plurality of second scan electrodes in a write period in the two-phase driving operation, and applies a fourth ramp waveform that drops from a seventh potential to an eighth potential to a plurality of third scan electrodes of the plurality of scan electrodes, and applies a fifth ramp waveform that drops from a ninth potential that is higher than the seventh potential to a tenth potential that is higher than the eighth potential to a plurality of fourth scan electrodes and a plurality of fifth scan electrodes of the plurality of scan electrodes in the setup period, sequentially applies a scan pulse to the plurality of third scan electrodes, applies a sixth ramp waveform that drops from an eleventh potential to a twelfth potential to the plurality of fourth scan electrodes after the scan pulse is applied to the plurality of third scan electrodes, sequentially applies a scan pulse to the plurality of fourth scan electrodes after the sixth ramp waveform is applied to the plurality of fourth scan electrodes, applies a seventh ramp waveform that drops from a thirteenth potential to a fourteenth potential to the plurality of fifth scan electrodes after the scan pulse is applied to the plurality of fourth scan electrodes, and sequentially applies a scan pulse to the plurality of fifth scan electrodes after the seventh ramp waveform is applied to the plurality of fifth scan electrodes in the write period in the three-phase driving operation.

According to the plasma display panel apparatus, the fourth ramp waveform that drops from the seventh potential to the eighth potential is applied to the plurality of third scan electrodes by the three-phase driving operation of the driving circuit in the setup period of at least the sub-field having the largest luminance weight of the plurality of sub-fields. This generates weak setup discharges in the discharge cells on the third scan electrodes, decreasing the amount of wall charges in the discharge cells. As a result, the amount of the wall charges in the discharge cells on the third scan electrodes can be made suitable for a write operation.

Moreover, the fifth ramp waveform that drops from the ninth potential to the tenth potential is applied to the plurality of fourth scan electrodes and the plurality of fifth scan electrodes. Here, the ninth potential of the fifth ramp waveform is higher than the seventh potential of the fourth ramp waveform, and the tenth potential of the fifth ramp waveform is higher than the eighth potential of the fourth ramp waveform. Therefore, the decrease of the wall charges in the discharge cells on the second and third scan electrodes is suppressed at the time of the application of the fifth ramp waveform. Accordingly, a sufficient amount of wall charges can remain in the discharge cells on the second and third scan electrodes at an end of the setup period.

Next, the scan pulse is sequentially applied to the plurality of third scan electrodes, the plurality of fourth scan electrodes and the plurality of fifth scan electrodes in the write period of at least the sub-field having the largest luminance weight. This generates the write discharges in the selected discharge cells on the third to fifth scan electrodes.

In this case, the sufficient amount of charges remains in the discharge cells on the fourth and fifth scan electrodes at the end of the setup period, as described above. Therefore, the amount of the wall charges in the discharge cells on the fourth and fifth scan electrodes can be made suitable for the write operation at the time of the application of the scan pulse to the fourth and fifth scan electrodes even though the wall charges of the discharge cells on the fourth and fifth scan electrodes are decreased during the application of the scan pulse to the third scan electrodes. As a result, discharge failures during the write discharges can be prevented from occurring in the discharge cells on the fourth and fifth scan electrodes in the write period.

In addition, the sixth ramp waveform is applied to the fourth scan electrodes after the scan pulse is applied to the third scan electrodes and before the scan pulse is applied to the fourth scan electrodes. Accordingly, weak setup discharges are generated in the discharge cells on the fourth scan electrodes, decreasing the amount of the wall charges in the discharge cells. In this case, the amount of the wall charges in the discharge cells on the fourth scan electrodes can be made suitable for the write operation immediately before the scan pulse is applied to the fourth scan electrodes. This reliably prevents the discharge failures during the write discharges from occurring in the discharge cells on the fourth scan electrodes.

In addition, the seventh ramp waveform is applied to the fifth scan electrodes after the scan pulse is applied to the fourth scan electrodes and before the scan pulse is applied to the fifth scan electrodes. This generates the weak setup discharges in the discharge cells on the fifth scan electrodes, decreasing the amount of the wall charges in the discharge cells. In this case, the amount of the wall charges in the discharge cells on the fifth scan electrodes can be made suitable for the write operation immediately before the scan pulse is applied to the fifth scan electrodes. This reliably prevents the discharge failures during the write discharges from occurring in the discharge cells on the fifth scan electrodes.

According to the plasma display panel apparatus, the first ramp waveform that drops from the first potential to the second potential is applied to the plurality of first scan electrodes by the two-phase driving operation of the driving circuit in the setup period of at least the one sub-field, which is not the sub-field having the largest luminance weight, of the plurality of sub-fields. This generates the weak setup discharges in the discharge cells on the first scan electrodes, and decreases the amount of the wall charges in the discharge cells. As a result, the amount of the wall charges in the discharge cells on the first scan electrodes can be made suitable for the write operation.

Moreover, the second ramp waveform that drops from the third potential to the fourth potential is applied to the plurality of second scan electrodes. Here, the third potential of the second ramp waveform is higher than the first potential of the first ramp waveform, and the fourth potential of the second ramp waveform is higher than the second potential of the first ramp waveform. Therefore, the decrease of the wall charges in the discharge cells on the second scan electrodes is suppressed at the time of the application of the second ramp waveform. Accordingly, a sufficient amount of wall charges can remain in the discharge cells on the second scan electrodes at the end of the setup period.

Next, the scan pulse is sequentially applied to the plurality of first scan electrodes and the plurality of second scan electrodes in the write period of at least the sub-field having the largest luminance weight. This generates the write discharges in the selected discharge cells on the first and second scan electrodes.

In this case, the sufficient amount of charges remains in the discharge cells on the second scan electrodes at the end of the setup period, as described above. Therefore, the amount of the wall charges in the discharge cells on the second scan electrodes can be made suitable for the write operation at the time of the application of the scan pulse to the second scan electrodes even though the wall charges of the discharge cells on the second scan electrodes are decreased during the application of the scan pulse to the first scan electrodes. As a result, discharge failures during the write discharges can be prevented from occurring in the discharge cells on the second scan electrodes in the write period.

The third ramp waveform is applied to the second scan electrodes after the scan pulse is applied to the first scan electrodes and before the scan pulse is applied to the second scan electrodes. This generates the weak setup discharges in the discharge cells on the second scan electrodes, decreasing the amount of the wall charges in the discharge cells. In this case, the amount of the wall charges in the discharge cells on the second scan electrodes can be made suitable for the write operation immediately before the scan pulse is applied to the second scan electrodes. As a result, the discharge failures during the write discharges can be reliably prevented from occurring in the discharge cells on the second scan electrodes.

Here, the wall charges are easily decreased in the write period of the sub-field having the large luminance weight. Therefore, the three-phase driving operation mentioned above is performed in at least the sub-field having the largest luminance weight in the plasma display panel apparatus. Thus, the sufficient amount of charges can reliably remain in the discharge cells on the fourth and fifth scan electrodes in the sub-field having the largest luminance weight.

In this case, the sufficient amount of charges can remain in the discharge cells on the fourth and fifth scan electrodes even though the potentials of the fourth and fifth scan electrodes are lowered to decrease the wall charges in the discharge cells on the fourth and fifth scan electrodes in the write period (excluding the period where the scan pulses are applied) of the sub-field having the largest luminance weight. Accordingly, the discharge cells can be reliably lit and the drive voltage generated by the voltage source can be decreased. This reduces cost for driving the plasma display panel and improves the driving performance thereof.

In the three-phase driving operation, the two ramp waveforms are applied to the plurality of scan electrodes in the write period. In the two-phase driving operation, the one ramp waveform is applied to the plurality of scan electrodes in the write period. That is, for driving the plurality of scan electrodes, the two-phase driving operation needs less ramp discharge to be applied than those needed in the three-phase driving operation. Therefore, the two-phase driving operation is performed in at least the one sub-field, which is not at least the sub-field having the largest luminance weight, in the plasma display panel apparatus. This causes a shorter time period to be required in at least the one sub-field. As a result, the sufficient sustain period can be ensured in each sub-field.

Effects of the Invention

According to the present invention, the two-phase driving operation or the three-phase driving operation is performed in at least the sub-field having the largest luminance weight of the plurality of sub-fields. This causes the sufficient amount of charges to remain in each discharge cell at the end of the setup period of the sub-field. As a result, the discharge failures during the write discharges can be prevented from occurring in each discharge cell in the write period.

BEST MODE FOR CARRYING OUT THE INVENTION

Figure 1:
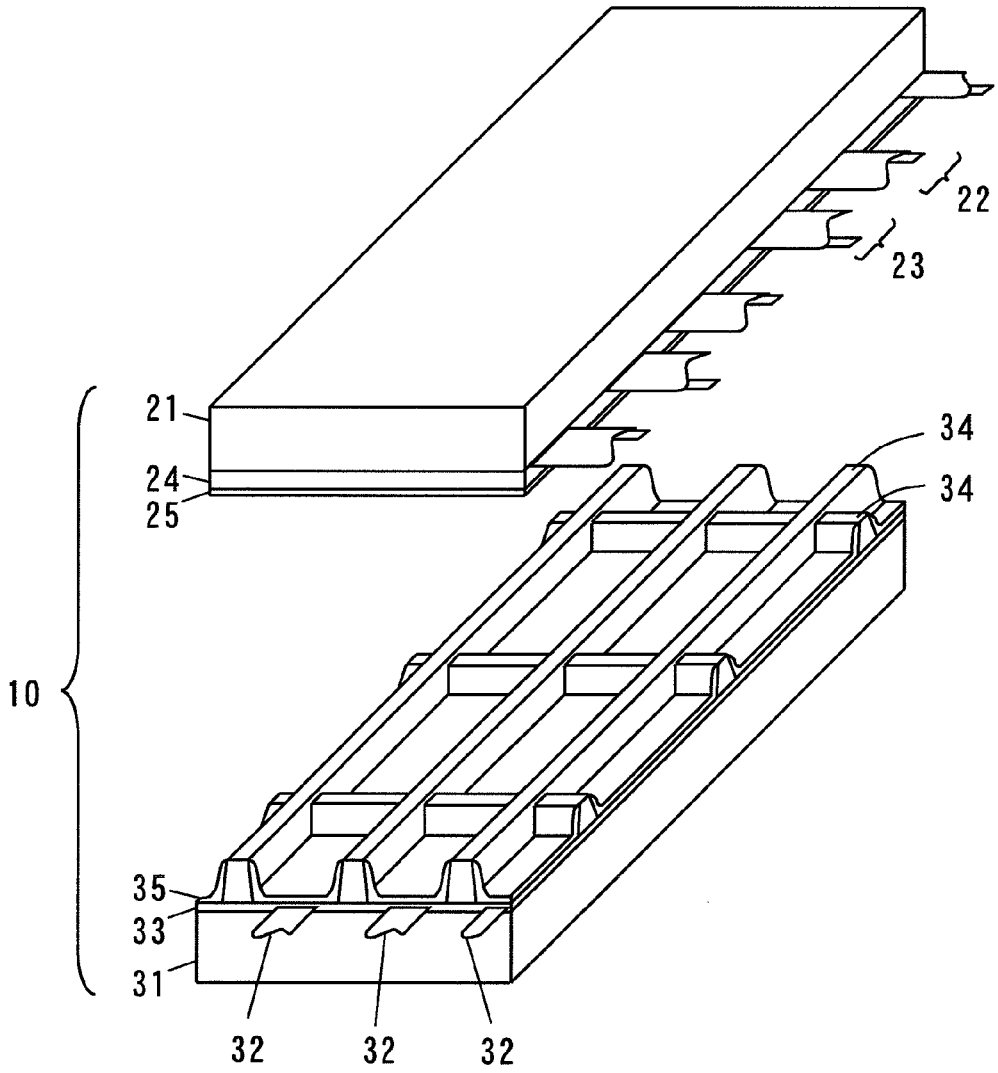
FIG. 1 is an exploded perspective view showing part of a plasma display panel in a plasma display apparatus according to a first embodiment.

The embodiments of the present invention will be described in detail referring to the drawings. The embodiments below describe a driving device of a plasma display panel and a plasma display apparatus including the same.

(1) First Embodiment (1-1) Configuration of Panel

FIG. 1 is an exploded perspective view showing part of a plasma display panel in a plasma display apparatus according to a first embodiment of the present invention.

The plasma display panel (hereinafter abbreviated as the panel) 10 includes a front substrate 21 and a back substrate 31 that are made of glass and arranged to face each other. A discharge space is formed between the front substrate 21 and the back substrate 31. A plurality of pairs of scan electrodes 22 and sustain electrodes 23 are formed in parallel with one another on the front substrate 21. Each pair of scan electrode 22 and sustain electrode 23 constitutes a display electrode. A dielectric layer 24 is formed to cover the scan electrodes 22 and the sustain electrodes 23, and a protective layer 25 is formed on the dielectric layer 24.

A plurality of data electrodes 32 covered with an insulator layer 33 are provided on the back substrate 31, and barrier ribs 34 are provided in a shape of a number sign on the insulator layer 33. Phosphor layers 35 are provided on a surface of the insulator layer 33 and side surfaces of the barrier ribs 34. Then, the front substrate 21 and the back substrate 31 are arranged to face each other such that the plurality of pairs of scan electrodes 22 and sustain electrodes 23 vertically intersect with the plurality of data electrodes 32, and the discharge space is formed between the front substrate 21 and the back substrate 31. The discharge space is filled with a mixed gas of neon and xenon, for example, as a discharge gas. Note that the configuration of the panel is not limited to the configuration described above. A configuration including the barrier ribs in a striped shape may be employed, for example.

Figure 2:
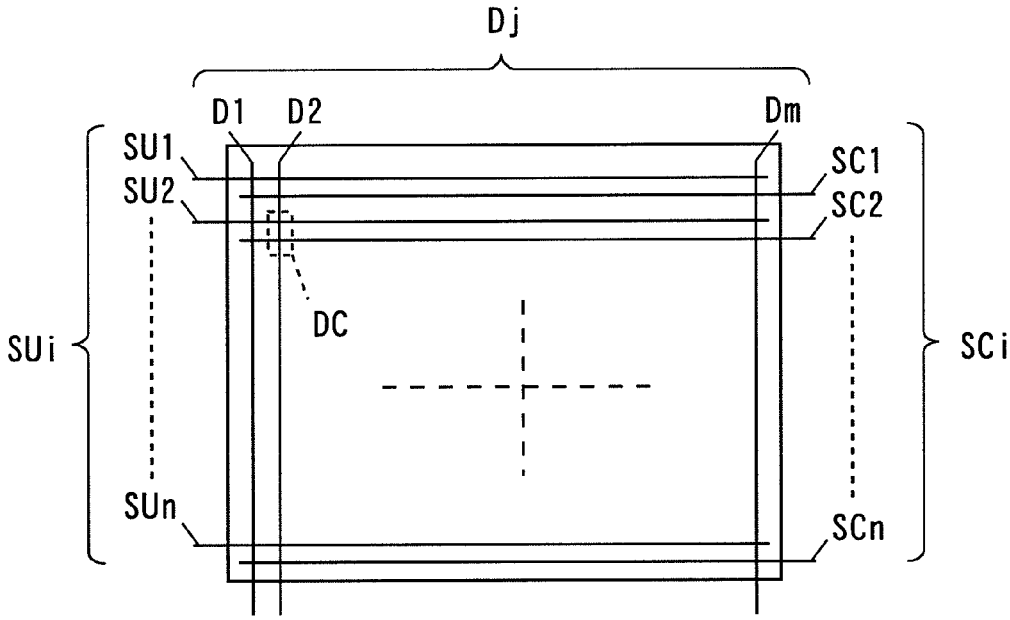
FIG. 2 is a diagram showing an arrangement of electrodes of the panel in the first embodiment.

FIG. 2 is a diagram showing an arrangement of the electrodes of the panel in the first embodiment of the present invention. N scan electrodes SC1 to SCn (the scan electrodes 22 of FIG. 1) and n sustain electrodes SU1 to SUn (the sustain electrodes 23 of FIG. 1) are arranged along a row direction, and m data electrodes D1 to Dm (the data electrodes 32 of FIG. 1) are arranged along a column direction. N is an even number, and m is a natural number of not less than two. Then, a discharge cell DC is formed at an intersection of a pair of scan electrode SCi (i=1 to n) and sustain electrode SUi (i=1 to n) with one data electrode Dj (j=1 to m). Accordingly, m×n discharge cells are formed in the discharge space.

(1-2) Configuration of the Plasma Display Apparatus

Figure 3:
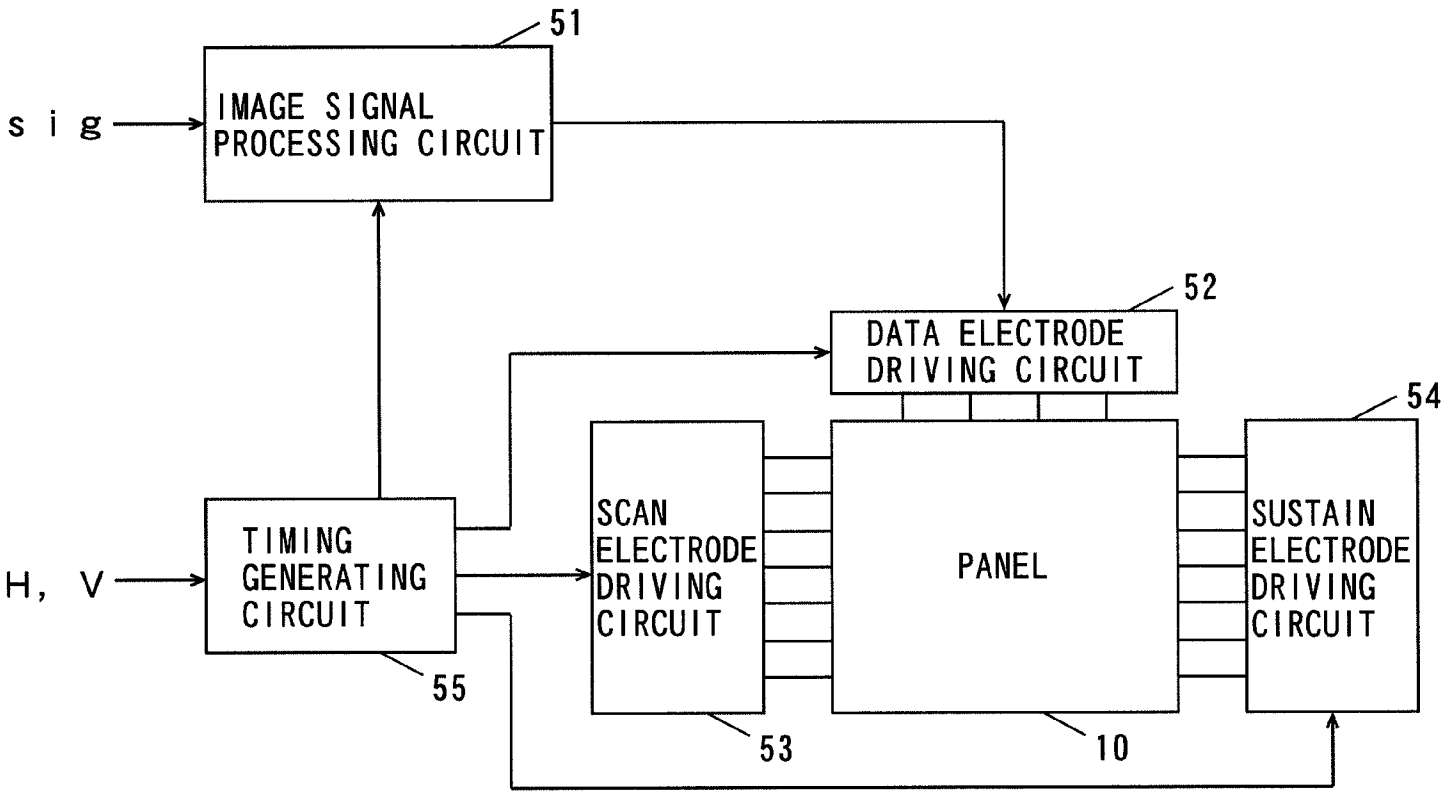
FIG. 3 is a block diagram of circuits in the plasma display apparatus according to the first embodiment of the present invention.

FIG. 3 is a block diagram of circuits in the plasma display apparatus according to the first embodiment of the present invention.

This plasma display apparatus includes the panel 10, an image signal processing circuit 51, a data electrode driving circuit 52, a scan electrode driving circuit 53, a sustain electrode driving circuit 54, a timing generating circuit 55 and a power supply circuit (not shown).

The image signal processing circuit 51 converts an image signal sig into image data corresponding to the number of pixels of the panel 10, divides the image data on each pixel into a plurality of bits corresponding to a plurality of sub-fields, and outputs them to the data electrode driving circuit 52.

The data electrode driving circuit 52 converts the image data for each sub-field into signals corresponding to the data electrodes D1 to Dm, respectively, and drives the data electrodes D1 to Dm based on the respective signals.

The timing generating circuit 55 generates a timing signal based on a horizontal synchronizing signal H and a vertical synchronizing signal V, and supplies the timing signal to each of the driving circuit blocks (the image signal processing circuit 51, the data electrode driving circuit 52, the scan electrode driving circuit 53 and the sustain electrode driving circuit 54).

The scan electrode driving circuit 53 applies driving voltage waveforms (hereinafter abbreviated as driving waveforms) to the scan electrodes SC1 to SCn based on the timing signal, and the sustain electrode driving circuit 54 applies driving waveforms to the sustain electrodes SU1 to SUn based on the timing signal.

Note that the scan electrode driving circuit 53 is capable of selectively performing in the setup period a one-phase driving operation in which the same driving waveforms are applied to all the scan electrodes SC1 to SCn and a two-phase driving operation in which different driving waveforms are applied to the scan electrodes SC1, SC3, . . . , SCn−1 and the scan electrodes SC2, SC4, . . . , SCn.

In the following description, the scan electrodes SC1, SC3, . . . , SCn−1 are referred to as a first scan electrode group, and the scan electrodes SC2, SC4, . . . , SCn are referred to as a second scan electrode group. The sustain electrodes SU1, SU3, . . . , SUn−1 are referred to as a first sustain electrode group, and the sustain electrodes SU2, SU4, . . . , SUn are referred to as a second sustain electrode group. A plurality of discharge cells constituted by the first scan electrode group and the first sustain electrode group are referred to as a first discharge cell group, and a plurality of discharge cells constituted by the second scan electrode group and the second sustain electrode group are referred to as a second discharge cell group.

(1-3) Sub-Field Configuration

Next, a sub-field configuration is explained. In a sub-field method, one field is divided into a plurality of sub-fields on a time base, and respective luminance weights are set for the plurality of sub-fields.

For example, one field is divided into ten sub-fields (hereinafter referred to as a first SF, a second SF, . . . and a tenth SF) on the time base, and the sub-fields have the luminance weights of 1, 2, 3, 6, 11, 18, 30, 44, 60 and 81, respectively.

Figure 4:
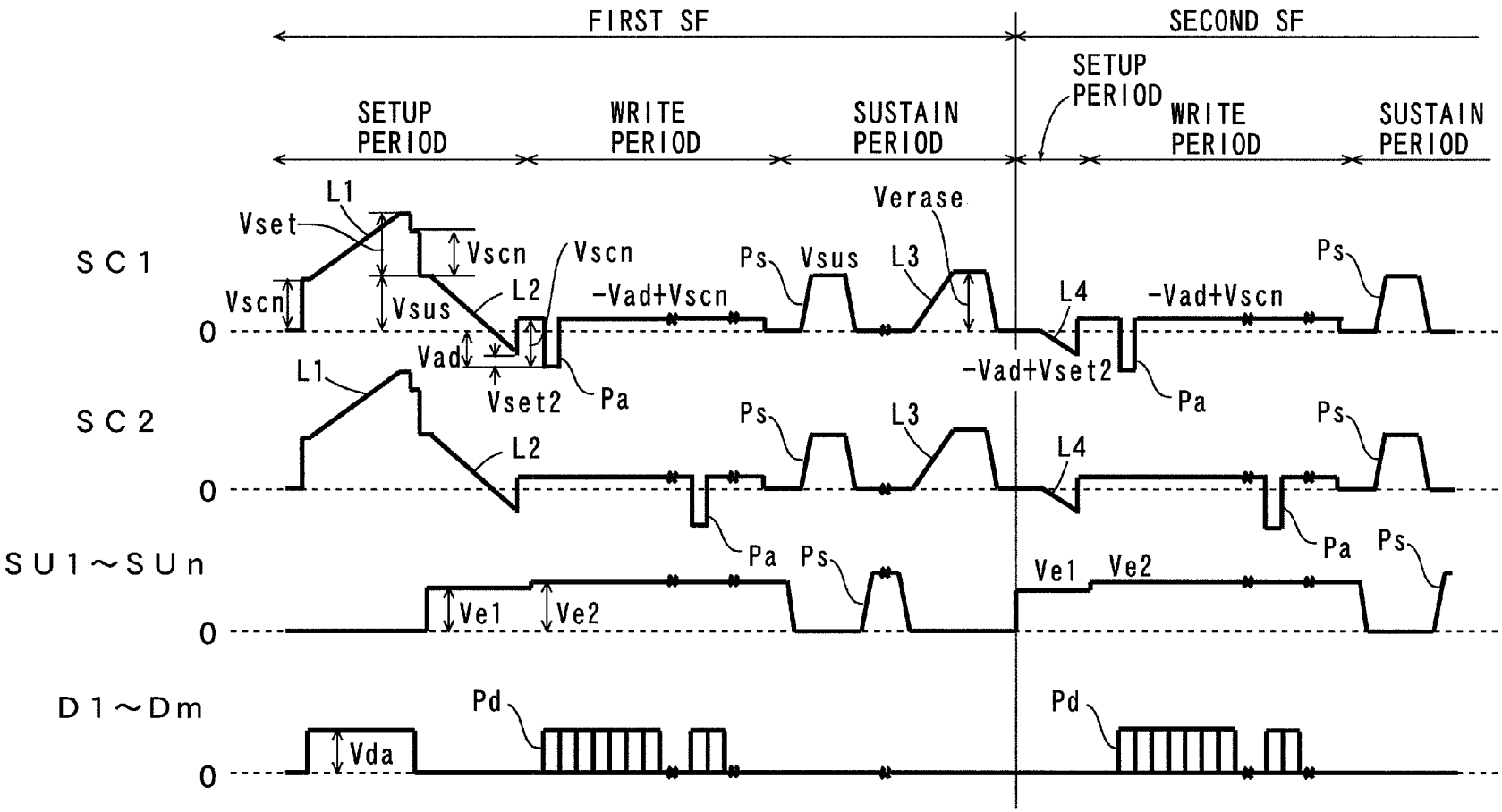
FIG. 4 is a driving waveform diagram in a sub-field configuration of the plasma display apparatus of FIG. 3.
Figure 5:
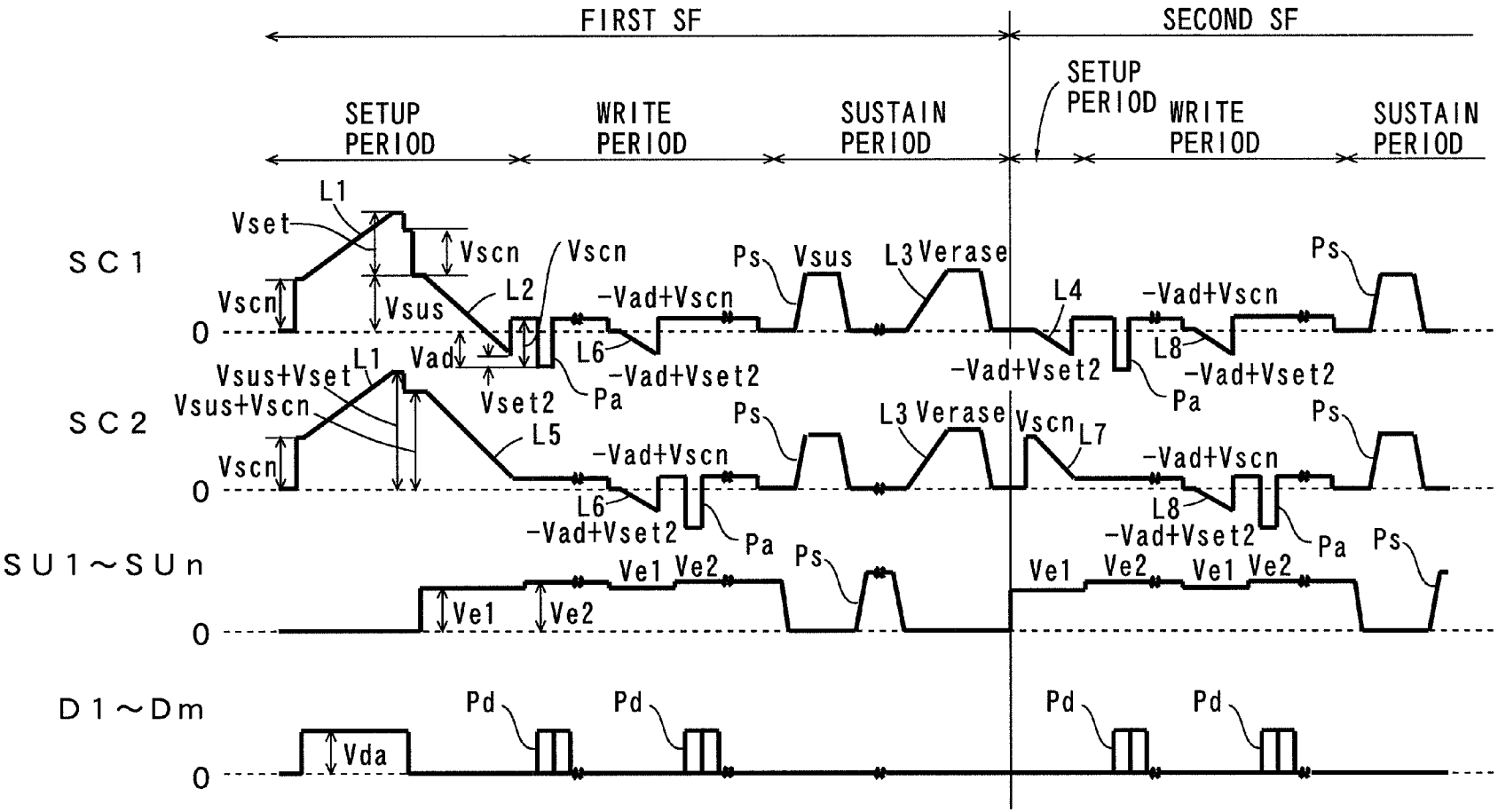
FIG. 5 is a driving waveform diagram in the sub-field configuration of the plasma display apparatus of FIG. 3.

FIGS. 4 and 5 are driving waveform diagrams in the sub-field configuration of the plasma display apparatus of FIG. 3. Note that FIG. 4 shows driving waveforms applied to respective electrodes in the one-phase driving operation of the scan electrode driving circuit 53, and FIG. 5 shows driving waveforms applied to the respective electrodes in the two-phase driving operation of the scan electrode driving circuit 53.

FIGS. 4 and 5 show the driving waveforms of the one scan electrode SC1 of the first scan electrode group, the one scan electrode SC2 of the second scan electrode group, the sustain electrodes SU1 to SUn, and the data electrodes D1 to Dm. A period from a setup period of the first SF to a sustain period of the second SF in one field is shown in FIGS. 4 and 5.

(a) The Driving Waveforms in the One-Phase Driving Operation

First, description is made of the driving waveforms applied to the respective electrodes in the one-phase driving operation of the scan electrode driving circuit 53.

As shown in FIG. 4, in the first half of the setup period of the first SF, the potential of the data electrodes D1 to Dm is held at Vda, the sustain electrodes SU1 to SUn are held at 0 V (the ground potential), and a ramp waveform L1 is applied to each of the scan electrodes SC1 to SCn.

The ramp waveform L1 gradually rises from a positive potential Vscn that is not more than a discharge start voltage toward a positive potential (Vsus+Vset) that exceeds the discharge start voltage. Then, first weak setup discharges are induced in all the discharge cells, so that negative wall charges are stored on the scan electrodes SC1 to SCn while positive wall charges are stored on the sustain electrodes SU1 to SUn and the data electrodes D1 to Dm, respectively. Here, a voltage caused by wall charges stored on the dielectric layer, the phosphor layer and so on covering the electrode is referred to as a wall voltage on the electrode.

In the subsequent second half of the setup period, the data electrodes D1 to Dm are held at the ground potential, the sustain electrodes SU1 to SUn are held at a positive potential Ve1, and a ramp waveform L2 that gradually drops from the positive potential (Vsus) toward a negative potential (−Vad+Vset2) is applied to each of the scan electrodes SC1 to SCn. Then, second weak setup discharges are induced in all the discharge cells, so that the wall voltage on the scan electrode SCi and the wall voltage on the sustain electrode SUi are weakened in all the discharge cells, and the wall voltage on the data electrode Dk is adjusted to a value suitable for a write operation.

In the first half of a write period of the first SF, the sustain electrodes SU1 to SUn are temporarily held at a potential Ve2, and the scan electrodes SC1 to SCn are temporarily held at a potential (−Vad+Vscn). Next, a positive write pulse Pd (=Vda) is applied to a data electrode Dk (k is any of 1 to m), among the data electrodes D1 to Dm, of the discharge cell that should emit light on a first row while a negative scan pulse Pa (=−Vad) is applied to the scan electrode SC1 on the first row. Then, a voltage at an intersection of the data electrode Dk and the scan electrode SC1 attains a value obtained by adding the wall voltage on the data electrode Dk and the wall voltage on the scan electrode SC1 to an externally applied voltage (Pd−Pa), exceeding the discharge start voltage. This generates a write discharge between the data electrode Dk and the scan electrode SC1 and between the sustain electrode SU1 and the scan electrode SC1. As a result, in the discharge cell, the positive wall charges are stored on the scan electrode SC1, the negative wall charges are stored on the sustain electrode SU1 and the negative wall charges are stored on the data electrode Dk.

In this manner, the write operation for generating the write discharge in the discharge cell that should emit light on the first row to cause the wall charges to be stored on each of the electrodes is performed. On the other hand, since a voltage at an intersection of a data electrode Dh (h≠k) to which the write pulse Pd has not been applied and the scan electrode SC1 does not exceed the discharge start voltage, the write discharge is not generated.

The above-described write operation is sequentially performed in the discharge cells on the first row to the n−1-th row of the first discharge cell group, and then the same write operation is sequentially performed in the discharge cells on the second row to the n-th row of the second discharge cell group. In this case, the scan pulse Pa is sequentially applied to the scan electrodes SC1, SC3, . . . , SCn−1 of the first scan electrode group, and then the scan pulse Pa is sequentially applied to the scan electrodes SC2, SC4, . . . , SCn of the second scan electrode group in the write period.

In a subsequent sustain period, the sustain electrodes SU1 to SUn are returned to the ground potential, and sustain pulses Ps (=Vsus) are applied to the scan electrodes SC1 to SCn for the first time in the sustain period. At this time, in the discharge cell in which the write discharge has been generated in the write period, a voltage between the scan electrode SCi and the sustain electrode SUi attains a value obtained by adding the wall voltage on the scan electrode SCi and the wall voltage on the sustain electrode SUi to the sustain pulse Ps (=Vsus), exceeding the discharge start voltage. This induces a sustain discharge between the scan electrode SCi and the sustain electrode SUi, causing the discharge cell to emit light. As a result, the negative wall charges are stored on the scan electrode SCi, the positive wall charges are stored on the sustain electrode SUi, and the positive wall charges are stored on the data electrode Dk.

In the discharge cell in which the write discharge has not been generated in the write period, the sustain discharge is not induced and the wall charges are held in a state at the end of the setup period. Next, the scan electrodes SC1 to SCn are returned to the ground potential, and the sustain pulses Ps are applied to the sustain electrodes SU1 to SUn. Then, since the voltage between the sustain electrode SUi and the scan electrode SCi exceeds the discharge start voltage in the discharge cell in which the sustain discharge has been induced, the sustain discharge is again induced between the sustain electrode SUi and the scan electrode SCi, the negative wall charges are stored on the sustain electrode SUi, and the positive wall charges are stored on the scan electrode SCi.

Similarly to the foregoing, a predetermined number of sustain pulses Ps are alternately applied to the respective scan electrodes SC1 to SCn and sustain electrodes SU1 to SUn, so that the sustain discharges are continuously performed in the discharge cells in which the write discharges have been generated in the write period.

After the sustain pulse Ps is applied, a ramp waveform L3 is applied to each of the scan electrodes SC1 to SCn while the sustain electrodes SU1 to SUn and the data electrodes D1 to Dm are held at the ground potential. The ramp waveform L3 gradually rises from the ground potential toward a positive potential Verase. This causes the voltage between the scan electrode SCi and the sustain electrode SUi to exceed the discharge start voltage, so that a weak erase discharge is generated between the sustain electrode SUi and the scan electrode SCi in the discharge cell in which the sustain discharge has been induced.

As a result, the negative wall charges are stored on the scan electrode SCi and the positive wall charges are stored on the sustain electrode SUi. At this time, the positive wall charges are stored on the data electrode Dk. Then, the scan electrodes SC1 to SCn are returned to the ground potential and the sustain operation in the sustain period is finished.

In a setup period of the second SF, the sustain electrodes SU1 to SUn are held at the potential Ve1, the data electrodes D1 to Dm are held at the ground potential, and a ramp waveform L4 that gradually drops from the ground potential toward the negative potential (−Vad+Vset2) is applied to the scan electrodes SC1 to SCn. Then, weak setup discharges are generated in the discharge cells in which the sustain discharges have been induced in the sustain period of the preceding sub-field (the first SF in FIG. 4). Accordingly, the wall voltages on the scan electrode SCi and the sustain electrode SUi are weakened in the discharge cells in which the sustain discharges have been induced in the preceding sub-field, and the wall voltage on the data electrode Dk is also adjusted to the value suitable for the write operation.

The discharges are not generated and the wall charges are kept constant in the state at the end of the setup period of the preceding sub-field in the discharge cells in which the sustain discharges have not been induced in the preceding sub-field.

In a write period of the second SF, the same driving waveforms as those in the write period of the first SF are applied to the scan electrodes SC1 to SCn, the sustain electrodes SU1 to SUn and the data electrodes D1 to Dm.

The predetermined number of sustain pulses Ps are alternately applied to the scan electrodes SC1 to SCn and the sustain electrodes SU1 to SUn in the sustain period of the second SF similarly to the sustain period of the first SF. Accordingly, the sustain discharges are performed in the discharge cells in which the write discharges have been generated in the write period.

The same driving waveforms as those in the second SF are applied to the first scan electrode group, the second scan electrode group, the sustain electrodes SU1 to SUn and the data electrodes D1 to Dm in the third SF and the subsequent SFs.

(b) Driving Waveforms in the Two-Phase Driving Operation

Next, description is made of driving waveforms applied to the respective electrodes in the two-phase driving operation of the scan electrode driving circuit 53. Note that the ramp waveforms L1 to L4 shown in FIG. 5 are the same as those of FIG. 4.

In the first half of the setup period of the first SF, the potential of the data electrodes D1 to Dm are held at Vda, the sustain electrodes SU1 to SUn are held at the ground potential, and the ramp waveform L1 is applied to each of the scan electrodes SC1 to SCn. Thus, the first weak setup discharges are induced in all the discharge cells, so that negative wall charges are stored on the scan electrodes SC1 to SCn while positive wall charges are stored on the sustain electrodes SU1 to SUn and the data electrodes D1 to Dm, respectively.

In the subsequent second half of the setup period, the data electrodes D1 to Dm are held at the ground potential, the sustain electrodes SU1 to SUn are held at the positive potential Ve1, and the ramp waveform L2 is applied to the first scan electrode group (the scan electrodes SC1, SC3, . . . , SCn−1). Then, the second weak setup discharges are induced in the first discharge cell group, so that the wall voltage on the scan electrode SCi and the wall voltage on the sustain electrode SUi are weakened in the first discharge cell group, and the wall voltage on the data electrode Dk is adjusted to a value suitable for the write operation.

On the other hand, a ramp waveform L5 that gradually drops from a positive potential (Vsus+Vscn) that is higher than Vsus toward a positive potential (−Vad+Vscn) is applied to the second scan electrode group (the scan electrodes SC2, SC4, . . . , SCn).

Here, the ramp waveform L5 applied to the second scan electrode group in the second half of the setup period drops from the potential that is higher by Vscn than the ramp waveform L2 applied to the first scan electrode group. Thus, generation of the second setup discharges is prevented in the second discharge cell group. In this case, the wall charges are maintained in a state at the end of the first setup discharges in the second discharge cell group.

In the first half of the write period of the first SF, the write operation is sequentially performed in the discharge cells on the first row to the n−1-th row of the first discharge cell group as described referring to FIG. 4.

After the write operation in the first discharge cell group is finished, the sustain electrodes SU1 to SUn are held at the potential Ve1, and a ramp waveform L6 that gradually drops from the ground potential toward the negative potential (−Vad+Vset2) is applied to all the scan electrodes SC1 to SCn.

Here, the scan pulse Pa is not applied to the second scan electrode group in a period where the scan pulse Pa is applied to the first scan electrode group. The wall charges of the second discharge cell group are decreased in this period. As described above, however, the second weak setup discharges are not generated in the setup period in the second discharge cell group. Therefore, a larger amount of wall charges are held in the second discharge cell group than in the first discharge cell group at a time point where the setup period is finished. Accordingly, a sufficient amount of wall charges is held in the second discharge cell group even though the wall charges in the second discharge cell group are decreased in the foregoing period.

In the present embodiment, the ramp waveform L6 that gradually drops from the ground potential toward the negative potential (−Vad+Vset2) is applied to each of the scan electrodes SC1 to SCn immediately before the scan pulse Pa is applied to the second scan electrode group. Then, the second weak setup discharges are induced in the second discharge cell group. Thus, the wall voltages on the scan electrode SCi and the sustain electrode SUi are weakened in the second discharge cell group, and the wall voltage on the data electrode Dk is also adjusted to a value suitable for the write operation.

That is, the setup operation for all the discharge cells belonging to the first discharge cell group (the setup operation for all the cells of the first discharge cell group) is performed in the setup period of the first SF, and the setup operation for all discharge cells belonging to the second discharge cell group (the setup operation for all the cells of the second discharge cell group) is performed in the setup period and the write period of the first SF in the two-phase driving operation of the scan electrode driving circuit 53.

In the second half of the write period of the first SF (after the application of the ramp waveform L6), the sustain electrodes SU1 to SUn are again held at the potential Ve2, and the scan electrodes SC1 to SCn are temporarily held at the potential (−Vad+Vscn). Next, the positive write pulse Pd is applied to a data electrode Dk, among the data electrodes D1 to Dm, of the discharge cell that should emit light on the second row while the negative scan pulse Pa is applied to the scan electrode SC2 on the second row. Then, a voltage at an intersection of the data electrode Dk and the scan electrode SC2 exceeds the discharge start voltage. This generates the write discharge between the data electrode Dk and the scan electrode SC2 and between the sustain electrode SU2 and the scan electrode SC2. As a result, in the discharge cell, the positive wall charges are stored on the scan electrode SC2, the negative wall charges are stored on the sustain electrode SU2 and the negative wall charges are stored on the data electrode Dk.

In this manner, the write operation for generating the write discharge in the discharge cell that should emit light on the second row to cause the wall charges to be stored on each of the electrodes is performed. On the other hand, since a voltage at an intersection of a data electrode Dh to which the write pulse Pd has not been applied and the scan electrode SC2 does not exceed the discharge start voltage, the write discharge is not generated.

The above-described write operation is sequentially performed in the discharge cells on the second row to the n-th row of the second discharge cell group, and the write period is finished.

In the subsequent sustain period, the sustain pulse Ps is alternately applied to the scan electrodes SC1 to SCn and the sustain electrodes SU1 to SUn as described referring to FIG. 4. Thus, the sustain discharges are generated in the discharge cells in which the write discharges have been generated in the write period.

After the application of the sustain pulse Ps, the ramp waveform L3 is applied to each of the scan electrodes SC1 to SCn as described referring to FIG. 4. Accordingly, the weak erase discharges are generated in the discharge cells in which the sustain discharges have been induced.

As a result, the negative wall charges are stored on the scan electrode SCi and the positive wall charges are stored on the sustain electrode SUi. At this time, the positive wall charges are stored on the data electrode Dk. Then, the scan electrodes SC1 to SCn are returned to the ground potential and the sustain operation in the sustain period is finished.

In the setup period of the second SF, the sustain electrodes SU1 to SUn are held at the potential Ve1, the data electrodes D1 to Dm are held at the ground potential, and the ramp waveform L4 is applied to the first scan electrode group (the scan electrodes SC1, SC3, . . . , SCn−1). Then, the weak setup discharges are generated in the discharge cells of the first discharge cell group in which the sustain discharges have been induced in the sustain period of the preceding sub-field (the first SF in FIG. 5). Accordingly, the wall voltages on the scan electrode SCi and the sustain electrode SUi are weakened in the discharge cells of the first discharge cell group in which the sustain discharges have been induced in the preceding sub-field, and the wall voltage on the data electrode Dk is also adjusted to the value suitable for the write operation.

The discharges are not generated and the wall charges are kept constant in the state at the end of the setup period of the preceding sub-field in the discharge cells in which the sustain discharges have not been induced in the preceding sub-field.

On the other hand, the potential Vscn is applied and a ramp waveform L7 that gradually drops from the potential Vscn toward the positive potential (−Vad+Vscn) is then applied to the second scan electrode group (the scan electrodes SC2, SC4, . . . , SCn). At this time, in the second discharge cell group, the setup discharges are not generated in the discharge cells in which the sustain discharges have not been induced in the preceding sub-field, and the setup discharges are not generated also in the discharge cells in which the sustain discharges have been induced.

In this case, the wall charges are kept constant in a state at the end of the sustain period of the preceding sub-field in the discharge cells of the second discharge cell group in which the sustain discharges have been induced in the preceding sub-field. Accordingly, the amount of the wall charges stored in the discharge cell of the second discharge cell group in which the sustain discharge has been induced in the preceding sub-field is sufficiently larger than the amount of the wall charges stored in each discharge cell of the first discharge cell group.

In the write period of the second SF, the same driving waveforms as those in the write period of the first SF are applied to the first scan electrode group, the second scan electrode group, the sustain electrodes SU1 to SUn and the data electrodes D1 to Dm.

In this case, the scan pulse Pa is not applied to the second scan electrode group in a period in which the scan pulse Pa is applied to the first scan electrode group in the write period of the second SF, similarly to the first SF. In this period, the wall charges of the second discharge cell group are decreased. As described above, however, the sufficient amount of charges are held at an end of the setup period of the second SF in the discharge cells of the second discharge cell group in which the sustain discharges have been induced in the preceding sub-field. Accordingly, the sufficient amount of wall charges is held in the discharge cells even though the wall charges of the discharge cells are decreased in the foregoing period.

In the present embodiment, a ramp waveform L8 that gradually drops from the ground potential toward the negative potential (−Vad+Vset2) is applied to each of the scan electrodes SC1 to SCn immediately before the scan pulse Pa is applied to the second scan electrode group. Then, the weak setup discharges are induced in the discharge cells of the second discharge cell group in which the sustain discharges have been induced in the preceding sub-field. Thus, the wall voltages on the scan electrode SCi and the sustain electrode SUi are weakened in the discharge cells of the second discharge cell group in which the sustain discharges have been induced in the preceding sub-field, and the wall voltage on the data electrode Dk is adjusted to the value suitable for the write operation.

That is, the selective setup operation is performed to the first discharge cell group in the setup period of the second SF, and the selective setup operation is performed to the second discharge cell group in the write period of the second SF in the two-phase driving operation of the scan electrode driving circuit 53. Note that the selective setup operation means an operation for selectively generating the setup discharges in the discharge cells in which the sustain discharges have been induced in the immediately preceding sub-field.

Note that the predetermined number of sustain pulses Ps are alternately applied to the scan electrodes SC1 to SCn and the sustain electrodes SU1 to SUn in the sustain period of the second SF similarly to the sustain period of the first SF. Accordingly, the sustain discharges are performed in the discharge cells in which the write discharges have been generated in the write period.

The same driving waveforms as those in the second SF are applied to the first scan electrode group, the second scan electrode group, the sustain electrodes SU1 to SUn and the data electrodes D1 to Dm in the third SF and the subsequent SFs.

(1-4) Configuration of the Scan Electrode Driving Circuit 53

Figure 6:
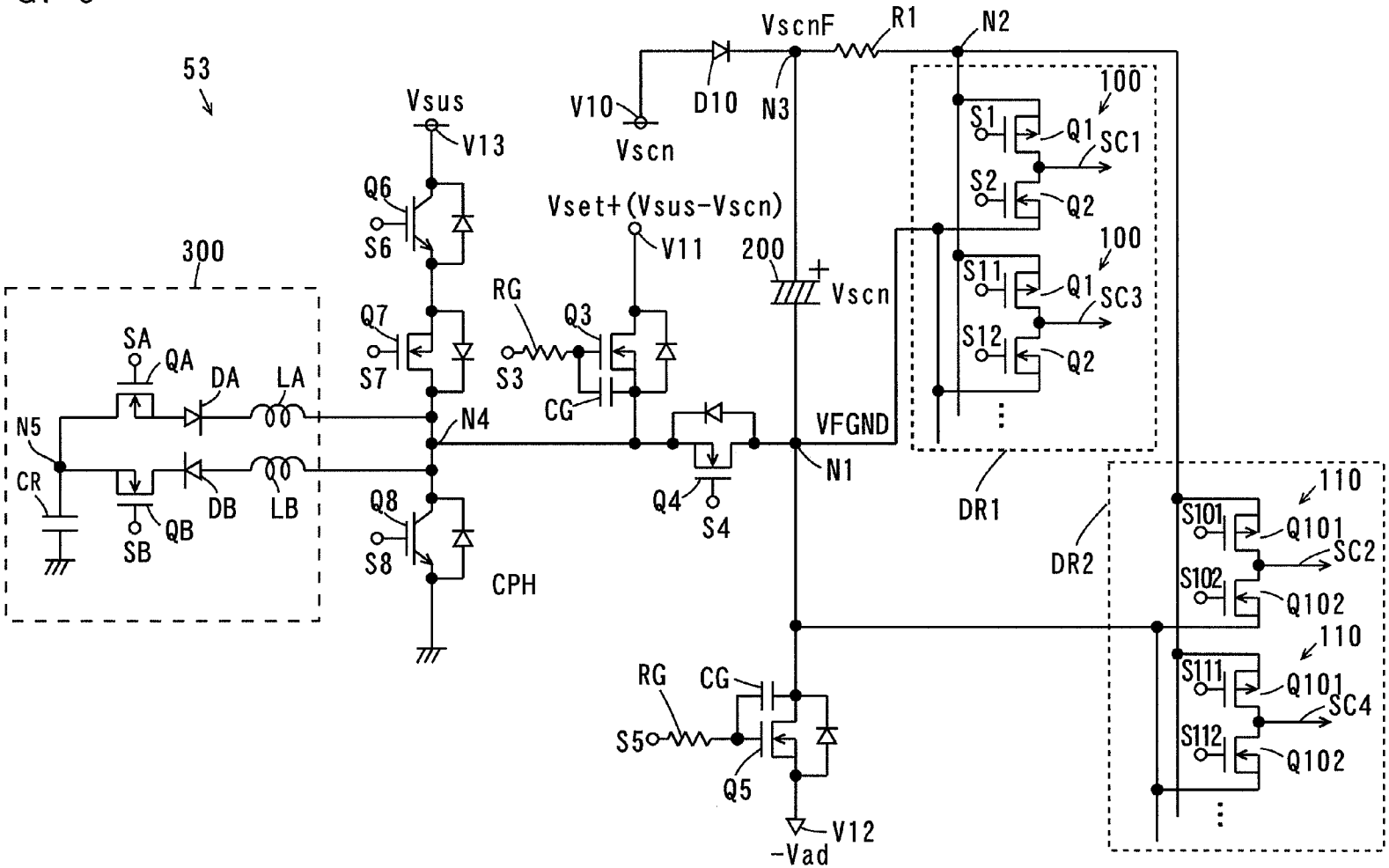
FIG. 6 is a circuit diagram showing the configuration of a scan electrode driving circuit.

FIG. 6 is a circuit diagram showing the configuration of the scan electrode driving circuit 53.

The scan electrode driving circuit 53 includes a first driving circuit DR1, a second driving circuit DR2, a DC power supply 200, a recovery circuit 300, a diode D10, n-channel field effect transistors (hereinafter abbreviated as transistors) Q3 to Q5, Q7 and NPN bipolar transistors (hereinafter abbreviated as transistors) Q6, Q8.

The first driving circuit DR1 includes a plurality of scan ICs 100. The plurality of scan ICs 100 are connected to the scan electrodes SC1, SC3, . . . , SCn−1, respectively, belonging to the first scan electrode group. FIG. 6 shows the two scan ICs 100 connected to the scan electrodes SC1, SC3, respectively.

Each scan IC 100 is connected between a node N1 and a node N2. Each scan IC 100 includes a p-channel field effect transistor (hereinafter abbreviated as a transistor) Q1 and an n-channel field effect transistor (hereinafter abbreviated as a transistor) Q2. Control signals S1, S2 are supplied to gates of the transistors Q1, Q2, respectively, of the scan IC 100 connected to the scan electrode SC1. Control signals S11, S12 are supplied to gates of the transistors Q1, Q2, respectively, of the scan IC 100 connected to the scan electrode SC3.

The second driving circuit DR2 includes a plurality of scan ICs 101. The plurality of scan ICs 101 are connected to the scan electrodes SC2, SC4, . . . , SCn, respectively, belonging to the second scan electrode group. FIG. 6 shows the two scan ICs 101 connected to the scan electrodes SC2, SC4, respectively.

Each scan IC 101 is connected between the node N1 and the node N2. Each scan IC 101 includes a p-channel field effect transistor (hereinafter abbreviated as a transistor) Q101 and an n-channel field effect transistor (hereinafter abbreviated as a transistor) Q102. Control signals S101, S102 are supplied to gates of the transistors Q101, Q102, respectively, of the scan IC 110 connected to the scan electrode SC2. Control signals S111, S112 are supplied to gates of the transistors Q101, Q102, respectively, of the scan IC 110 connected to the scan electrode SC4.

The recovery circuit 300 includes n-channel field effect transistors (hereinafter abbreviated as transistors) QA, QB, recovery coils LA, LB, a recovery capacitor CR and diodes DA, DB.

A power supply terminal V10 that receives the voltage Vscn is connected to a node N3 through the diode D10. The DC power supply 200 is connected between the node N1 and the node N3. The DC power supply 200 is composed of an electrolytic capacitor, and functions as a floating power supply that holds the voltage Vscn. A protective resistor R1 is connected between the node N2 and the node N3. Hereinafter, the potential of the node N1 is referred to as VFGND, and the potential of the node N3 is referred to as VscnF. The potential VscnF of the node N3 has a value obtained by adding the voltage Vscn to the potential VFGND of the node N1. That is, VscnF=VFGND+Vscn.

The transistor Q3 is connected between a power supply terminal V11 that receives a voltage (Vset+(Vsus−Vscn)) and a node N4, and a control signal S3 is supplied to its gate. The transistor Q4 is connected between the node N1 and the node N4, and a control signal S4 is supplied to its gate. The transistor Q5 is connected between the node N1 and a power supply terminal V12 that receives the negative voltage (−Vad), and a control signal S5 is applied to its gate. The control signal S4 is an inverted signal of the control signal S5.

In addition, a gate resistor RG and a capacitor CG are connected to the transistor Q3, and a gate resistor RG and a capacitor CG are connected to the transistor Q5. Note that a gate resistor and a capacitor, not shown, are also connected to the transistor Q6.

The transistors Q6, Q7 are connected between a power supply terminal V13 that receives the voltage Vsus and the node N4. A control signal S6 is supplied to a base of the transistor Q6, and a control signal S7 is supplied to a gate of the transistor Q7. The transistor Q8 is connected between the node N4 and a ground terminal, and a control signal S8 is supplied to its base.

Between the node N4 and a node N5, the recovery coil LA, the diode DA and the transistor QA are connected in series, and the recovery coil LB, the diode DB and the transistor QB are connected in series. The recovery capacitor CR is connected between the node N5 and the ground terminal.

(1-5) Operation of the Scan Electrode Driving Circuit

Next, description is made of operation of the scan electrode driving circuit 53.

Here, first, the operation of the scan electrode driving circuit 53 in the two-phase driving operation is described, because the operation of the scan electrode driving circuit 53 in the one-phase driving operation can be easily described based on the operation of the scan electrode driving circuit 53 in the two-phase driving operation.

Figure 7:
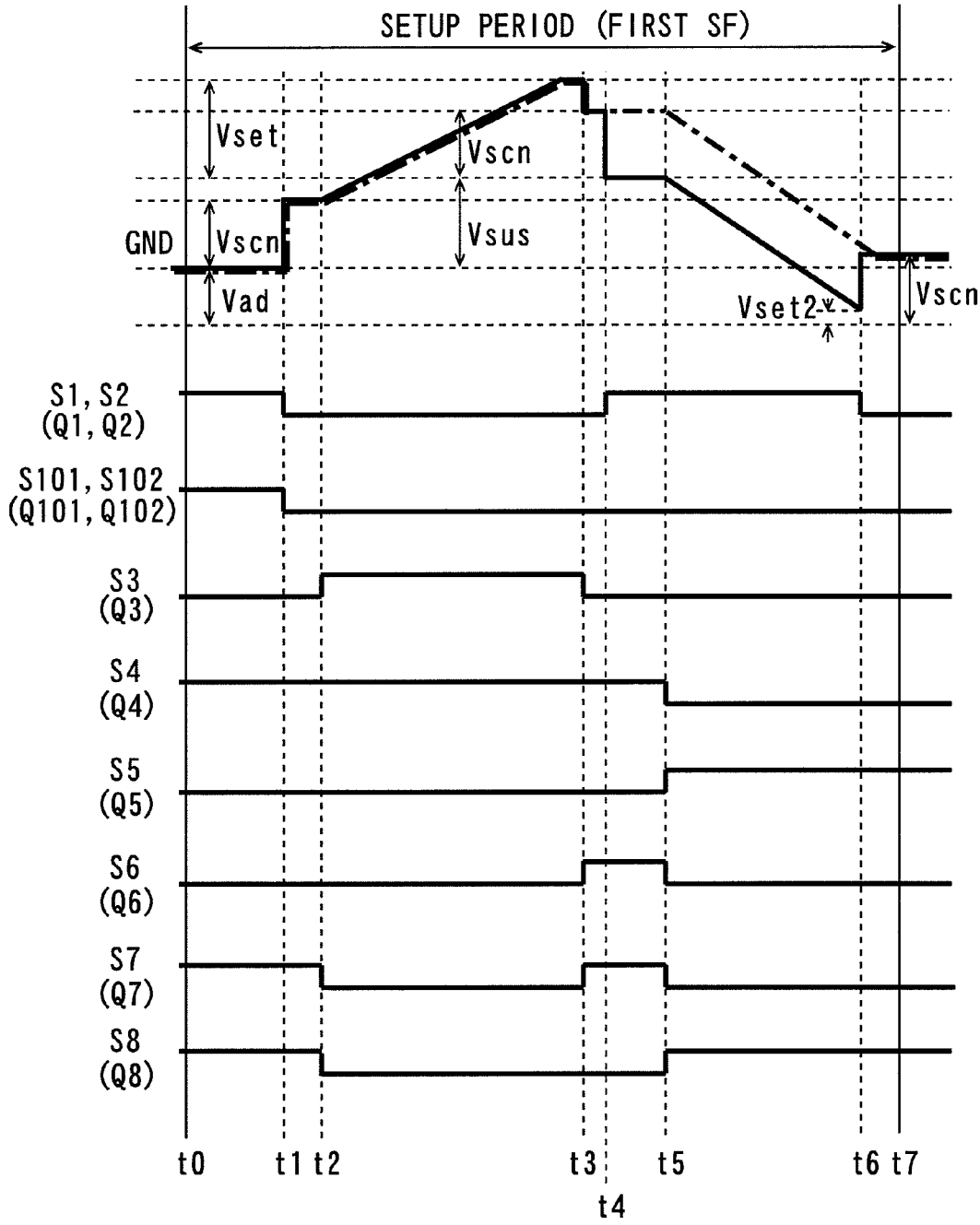
FIG. 7 is a detailed timing chart of control signals applied to transistors in a two-phase driving operation of the scan electrode driving circuit.
Figure 8:
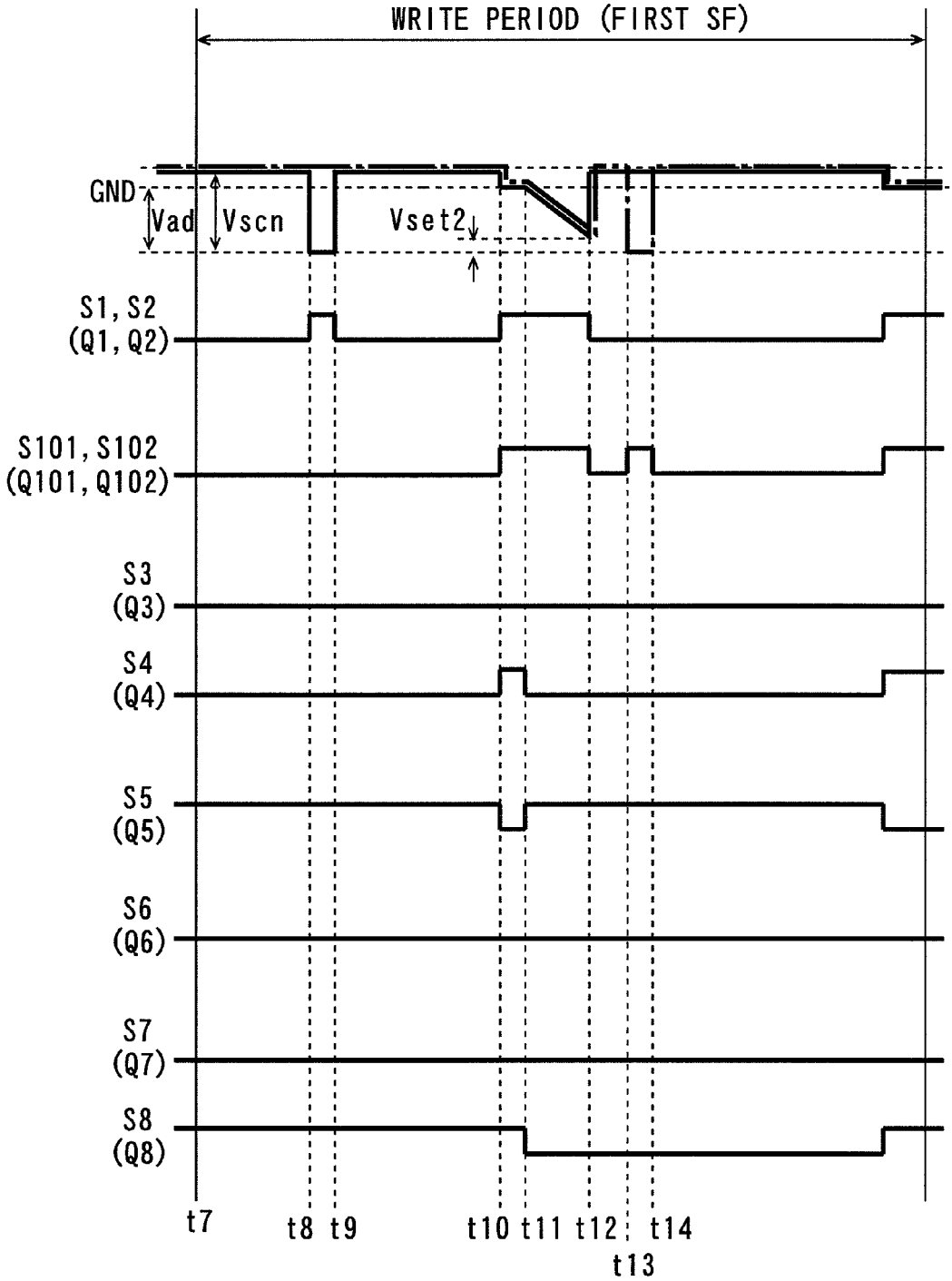
FIG. 8 is a detailed timing chart of the control signals applied to the transistors in the two-phase driving operation of the scan electrode driving circuit.
Figure 9:
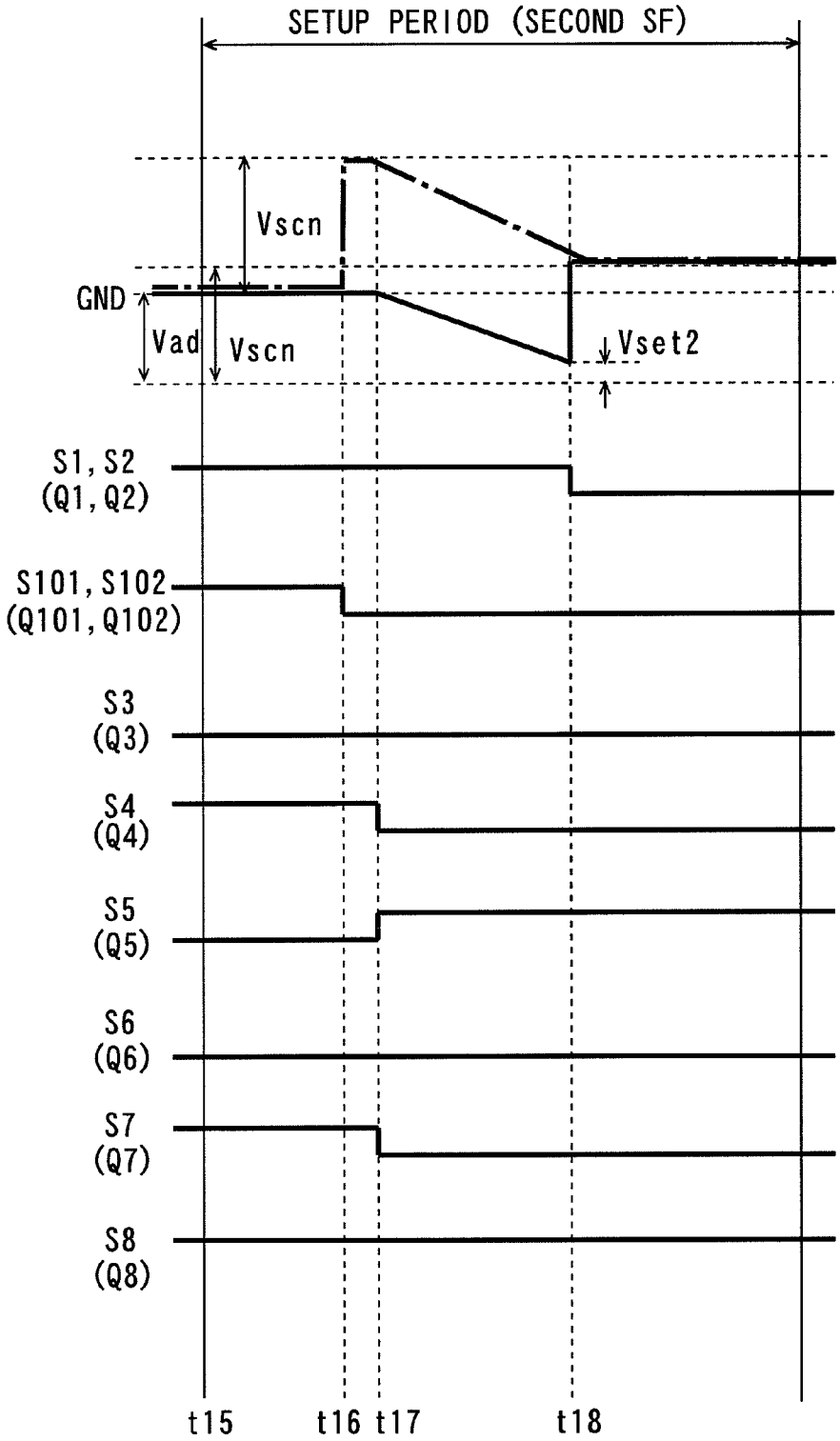
FIG. 9 is a detailed timing chart of the control signals applied to the transistors in the two-phase driving operation of the scan electrode driving circuit.

(a) The Operation of the Scan Electrode Driving Circuit in the Two-Phase Driving Operation FIGS. 7 to 9 are detailed timing charts of the control signals supplied to the transistors Q1 to Q8 in the two-phase driving operation of the scan electrode driving circuit 53. Note that FIG. 7 is the timing chart in the setup period of the first SF of FIG. 5, FIG. 8 is the timing chart in the write period of the first SF of FIG. 5, and FIG. 9 is the timing chart in the setup period of the second SF of FIG. 5.

Change of the potential of the scan electrode SC1 is indicated by the solid line, and change of the potential of the scan electrode SC2 is indicated by the one-dot and dash line in the top stages of FIGS. 7 to 9. Note that control signals SA, SB applied to the recovery circuit 300 are not shown in FIGS. 7 to 9.

At a starting time point t0 of the setup period of the first SF of FIG. 7, the control signals S1, S2, S101, S102, S4, S7, S8 are at a high level, and the control signals S3, S5, S6 are at a low level. This causes the transistors Q1, Q101, Q3, Q5, Q6 to be turned off and the transistors Q2, Q102, Q4, Q7, Q8 to be turned on. Thus, the node N1 attains the ground potential (0 V) and the potential VscnF of the node N3 attains Vscn. Since the transistors Q2, Q102 are turned on, the potentials of the scan electrodes SC1, SC2 attain the ground potential.

The control signals S1, S2, S101, S102 attain a low level at a time point t1. This causes the transistors Q1, Q101 to be turned on and the transistors Q2, Q102 to be turned off. Thus, the potentials of the scan electrodes SC1, SC2 rise to Vscn.

The control signals S7, S8 attain a low level and the transistors Q7, Q8 are turned off at a time point t2. Thus, the potential VFGND of the node N1 gradually rises to (Vset+(Vsus-Vscn) by an RC integration circuit constituted by the gate resistor RG and the capacitor CG connected to the transistor Q3. In addition, the potential VscnF of the node N3 gradually rises to (Vsus+Vset). At this time, since the transistors Q1, Q101 are turned on, the potentials of the scan electrodes SC1, SC2 gradually rise to (Vsus+Vset).

At a time point t3, the control signal S3 attains a low level and the control signals S6, S7 attain a high level. This causes the transistor Q3 to be turned off and the transistors Q6, Q7 to be turned on. As a result, the potential VFGND of the node N1 drops to Vsus and the potential VscnF of the node N3 drops to (Vscn+Vsus). At this time, since the transistors Q1, Q101 are turned on, the potentials of the scan electrodes SC1, SC2 drop to (Vscn+Vsus).

At a time point t4, the control signals S1, S2 attain a high level. This causes the transistor Q1 to be turned off and the transistor Q2 to be turned on. At this time, the potential of the potential VFGND of the node N1 attains Vsus, so that the potential of the scan electrode SC1 drops to Vsus. On the other hand, the transistor Q101 is maintained in an ON state and the transistor Q102 is maintained in an OFF state, thus causing the potential of the scan electrode SC2 to be maintained in (Vscn+Vsus).

At a time point t5, the control signals S4, S6, S7 attain a low level, and the control signals S5, S8 attain a high level. This causes the transistors Q4, Q6, Q7 to be turned off, and the transistors Q5, Q8 to be turned on. As a result, the potential VFGND of the node N1 gradually drops toward (−Vad) by an RC integration circuit constituted by the gate resistor RG and the capacitor CG connected to the transistor Q5. Moreover, the potential of the potential VscnF of the node N3 gradually drops toward (−Vad+Vscn). At this time, since the transistors Q2, Q101 are turned on, the potential of the scan electrode SC1 gradually drops toward (−Vad), and the potential of the scan electrode SC2 gradually drops toward (−Vad+Vscn).

The control signals S1, S2 attain a low level at a time point t6. This causes the transistor Q1 to be turned on and the transistor Q2 to be turned off. As a result, the potential of the scan electrode SC1 rises to (−Vad+Vscn). At this time, since the transistor Q101 is maintained in an ON state, the potential of the scan electrode SC2 drops to (−Vad+Vscn).

The control signals S1, S2 attain a high level at a time point t8 of the write period of the first SF of FIG. 8. This causes the transistor Q1 to be turned off and the transistor Q2 to be turned on. At this time, since the potential VFGND of the node N1 attains (−Vad), the potential of the scan electrode SC1 drops to (−Vad). On the other hand, the transistor Q101 is maintained in an ON state and the transistor Q102 is maintained in an OFF state, so that the potential of the scan electrode SC2 is maintained in (−Vad+Vscn).

The control signals S1, S2 attain a low level at a time point t9. This causes the transistor Q1 to be turned on and the transistor Q2 to be turned off. At this time, since the potential VscnF of the node N3 attains (−Vad+Vscn), the potential of the scan electrode SC1 rises to (−Vad+Vscn). The transistor Q101 is maintained in an ON state and the transistor Q102 is maintained in an OFF state, so that the potential of the scan electrode SC2 is maintained in (−Vad+Vscn).

The control signal S4 attains a high level and the control signal S5 attains a low level at a time point t10. This causes the transistor Q4 to be turned on and the transistor Q5 to be turned off. As a result, the potential VFGND of the node N1 rises to the ground potential, and the potential VscnF of the node N3 rises to Vscn. In addition, the control signals S1, S2, S102, S101 attain a high level. This causes the transistors Q1, Q101 to be turned off and the transistors Q2, Q102 to be turned on. Accordingly, the potentials of the scan electrodes SC1, SC2 drop to the ground potential.

The control signal S4 attains a low level and the control signal S5 attains a high level at a time point t11. This causes the transistor Q4 to be turned off and the transistor Q5 to be turned on. As a result, the potential VFGND of the node N1 gradually drops toward (−Vad) by the RC integration circuit constituted by the gate resistor RG and the capacitor CG connected to the transistor Q5. Moreover, the potential of the potential VscnF of the node N3 gradually drops toward (−Vad+Vscn). At this time, since the transistors Q2, Q102 are turned on, the potentials of the scan electrodes SC1, SC2 gradually drop toward (−Vad).

The control signals S1, S2, S101, S102 attain a low level at a time point t12. This causes the transistors Q1, Q101 to be turned on and the transistors Q2, Q102 to be turned off. At this time, since the potential VscnF of the node N3 attains (−Vad+Vscn), the potentials of the scan electrodes SC1, SC2 rise to (−Vad+Vscn).

The control signals S101, SO2 attain a high level at a time point t13. This causes the transistor Q101 to be turned off and the transistor Q102 to be turned on. At this time, since the potential VFGND of the node N1 attains (−Vad), the potential of the scan electrode SC2 drops to (−Vad). The states of the transistors Q1, Q2 are maintained, so that the potential of the scan electrode SC1 is maintained in (−Vad+Vscn).

The control signals S101, S102 attain a low level at a time point t14. This causes the transistor Q101 to be turned on and the transistor Q102 to be turned off. At this time, since the potential VscnF of the node N3 attains (−Vad+Vscn), the potential of the scan electrode SC2 rises to (−Vad+Vscn). The states of the transistors Q1, Q2 are maintained, so that the potential of the scan electrode SC1 is maintained in (−Vad+Vscn).

At a starting time point t15 of the setup period of the second SF of FIG. 9, the control signals S3, S5, S6 attain a low level and the control signals S1, S2, S101, S101, S4, S7, S8 attain a high level. This causes the transistors Q1, Q101, Q3, Q5, Q6 to be turned off and the transistors Q2, Q102, Q4, Q7, Q8 to be turned on. Thus, the potential VFGND of the node N1 attains the ground potential, and the potential VscnF of the node N3 attains Vscn. In addition, since the transistors Q2, Q102 are turned on, the potentials of the scan electrodes SC1, SC2 attain the ground potential.

The control signals S101, S102 attain a low level at a time point t16. This causes the transistor Q101 to be turned on and the transistor Q102 to be turned off. At this time, since the potential VscnF of the node N3 attains Vscn, the potential of the scan electrode SC2 rises to Vscn. Since the states of the transistors Q1, Q2 are maintained, the potential of the scan electrode SC1 is maintained at the ground potential.

The control signals S4, S7 attain a low level and the control signal S5 attains a high level at a time point t17. This causes the transistors Q4, Q7 to be turned off and the transistor Q5 to be turned on. As a result, the potential VFGND of the node N1 gradually drops toward (−Vad) by the RC integration circuit constituted by the gate resistor RG and the capacitor CG connected to the transistor Q5. In addition, the potential VscnF of the node N3 gradually drops toward (−Vad+Vscn). At this time, since the transistors Q2, Q101 are turned on, the potential of the scan electrode SC1 gradually drops toward (−Vad), and the potential of the scan electrode SC2 gradually drops toward (−Vad+Vscn).

The control signals S1, S2 attain a low level at a time point t18. This causes the transistor Q1 to be turned on and the transistor Q2 to be turned off. As a result, the potential of the scan electrode SC1 rises to (−Vad+Vscn). At this time, since the transistor Q101 is maintained in an ON state, the potential of the scan electrode SC2 drops to (−Vad+Vscn).

(b) The Operation of the Scan Electrode Driving Circuit in the One-Phase Driving Operation Next, description is made of the operation of the scan electrode driving circuit 53 in the one-phase driving operation.

Figure 10:
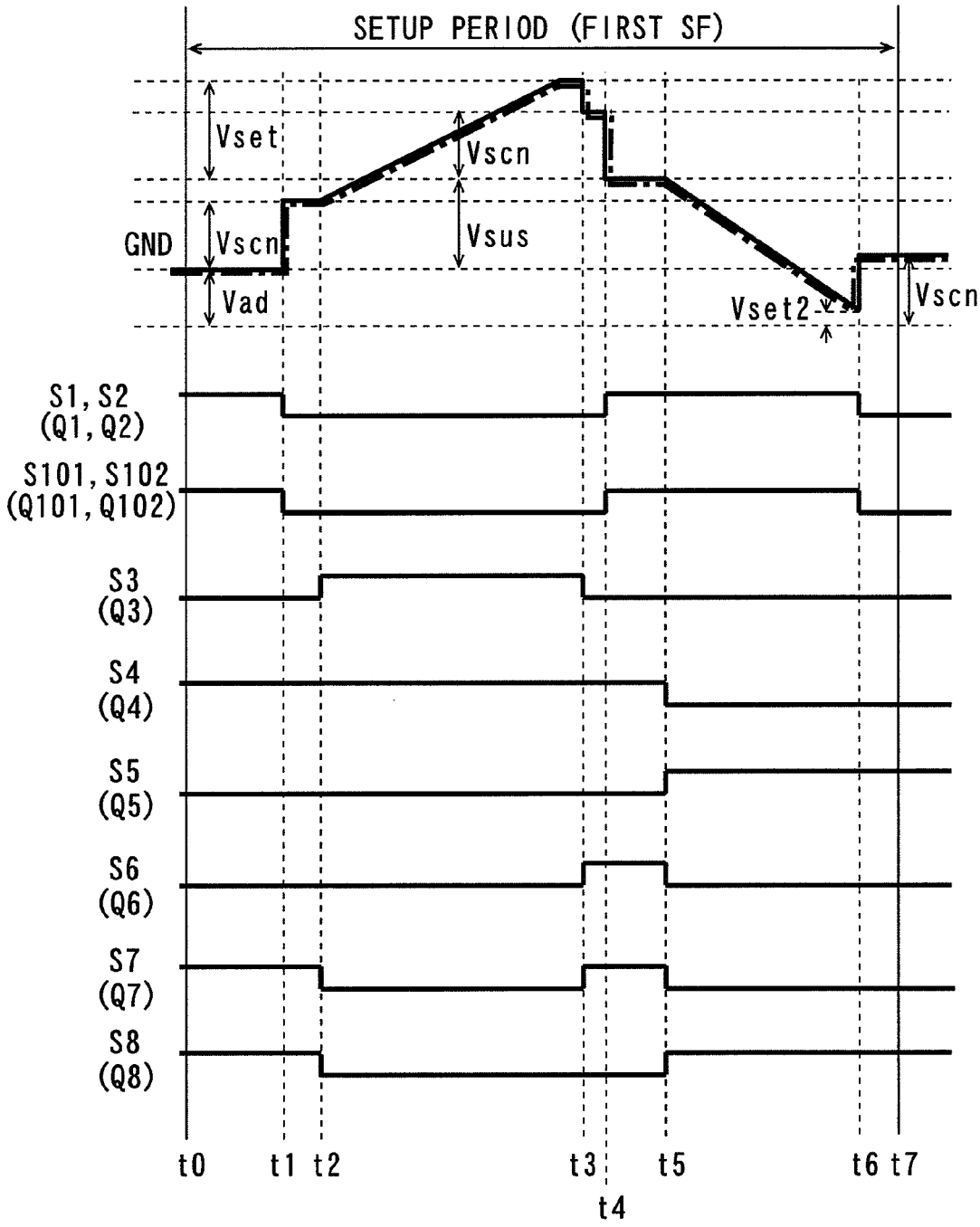
FIG. 10 is a detailed timing chart of the control signals applied to the transistors in a one-phase driving operation of the scan electrode driving circuit.
Figure 11:
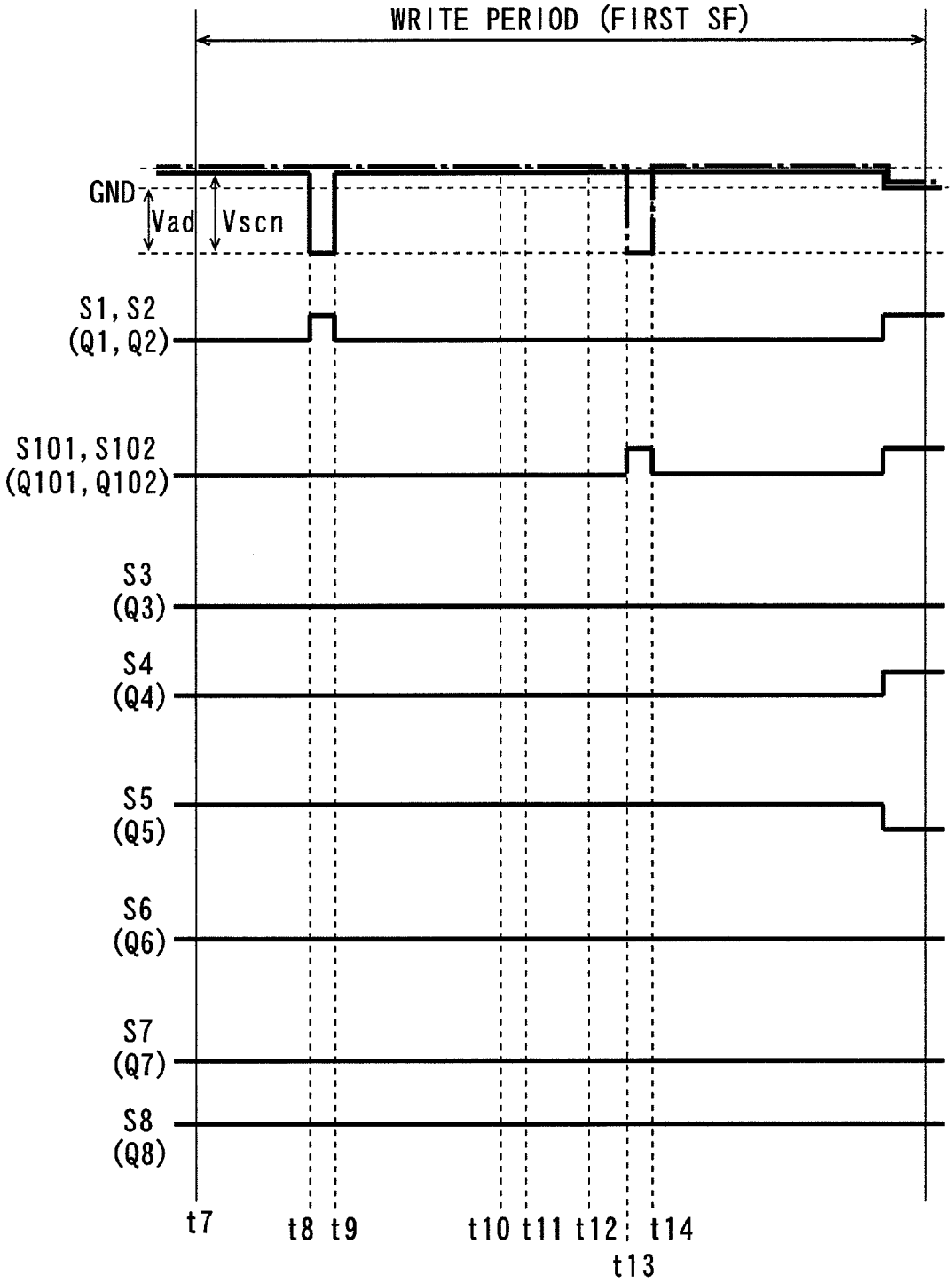
FIG. 11 is a detailed timing chart of the control signals applied to the transistors in the one-phase driving operation of the scan electrode driving circuit.
Figure 12:
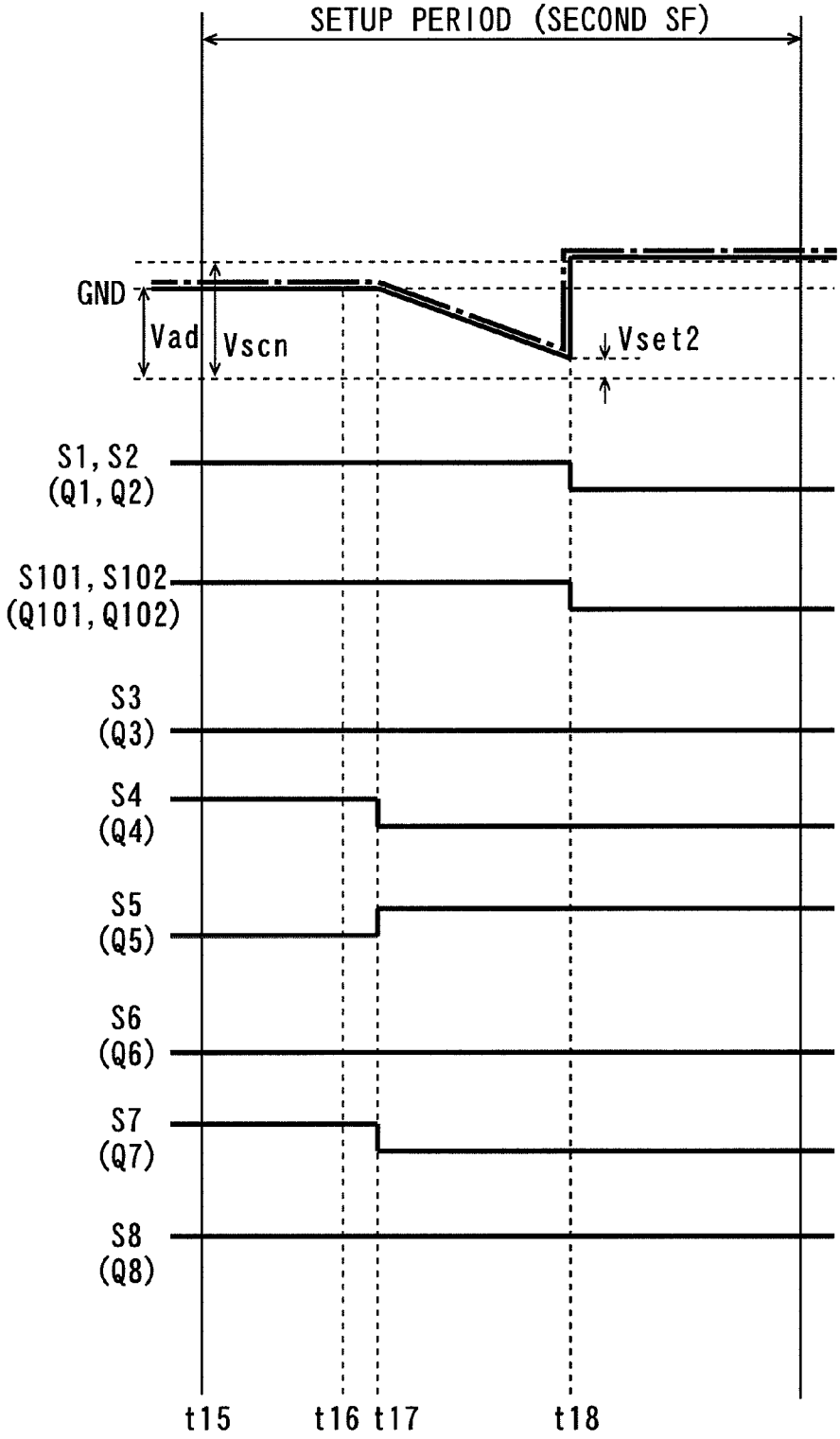
FIG. 12 is a detailed timing chart of the control signals applied to the transistors in the one-phase driving operation of the scan electrode driving circuit.

FIGS. 10 to 12 are detailed timing charts of the control signals applied to the transistors Q1 to Q8 in the one-phase driving operation of the scan electrode driving circuit 53. The timing charts in FIGS. 10 to 12 are different from those in FIGS. 7 to 9 in the following points.

As shown in FIG. 10, the control signals S101, SO2 attain a high level to cause the transistor Q101 to be turned off and the transistor Q102 to be turned on at the time point t4 in the one-phase driving operation of the scan electrode driving circuit 53. At the time point t6, the control signals S101, S102 attain a low level to cause the transistor Q101 to be turned on and the transistor Q102 to be turned off. That is, the transistors Q101, Q102 are turned on/off in the same manner as the transistors Q1, Q2, respectively, in the setup period. Accordingly, the potential of the scan electrode SC2 changes in the same manner as the scan electrode SC1.

As shown in FIG. 11, the control signals S1, S2, S101, S102, S4 are maintained in a low level, and the control signals S5, S8 are maintained in a high level in a period from the time point t10 to the time point t12. In this case, the transistor Q4 is maintained in an OFF state, the transistor Q5 is maintained in an ON state, and the transistors Q1, Q101 are maintained in an ON state. Accordingly, the scan electrodes SC1, SC2 are maintained in the potential (−Vad+Vscn).

As shown in FIG. 12, the control signals S101, S102 are maintained in a high level in a period from the time point t16 to the time point t18. In this case, the transistor Q101 is maintained in an OFF state, and the transistor Q102 is maintained in an ON state. Moreover, the control signals S101, S102 attain a low level at the time point t18 to cause the transistor Q101 to be turned on and the transistor Q102 to be turned off. That is, the transistors Q101, Q102 are turned on/off in the same manner as the transistors Q1, Q2, respectively, in the period from the time point t16 to the time point t18. Accordingly, the potential of the scan electrode SC2 changes in the same manner as the scan electrode SC1.

(1-6) Effects of the Two-Phase Driving Operation and Utilizing Method Thereof (a) Effects of the Two-Phase Driving Operation As described above, in the two-phase driving operation, the weak discharge for setup (the second weak discharge in the first SF) is not generated in the setup period in each discharge cell of the second discharge cell group. Therefore, the sufficient amount of charges can be stored in each discharge cell of the second discharge cell group at the starting time point of the write period.

In this case, the occurrence of discharge failures to be caused by the decrease of the wall charges can be prevented in the second discharge cell group even though the wall charges stored in each discharge cell are decreased by the time when the scan pulse Pa is applied to each discharge cell of the second discharge cell group.

Moreover, the sufficient amount of charges can remain in each discharge cell even though the potential (−Vad+Vscn) of the scan electrodes SC2, SC4, . . . , SCn (the second discharge cell group) is lowered to decrease the wall charges in each discharge cell of the second discharge cell group in the write period (excluding the period where the scan pulse Pa is applied). Since the potential of the scan electrodes SC2, SC4, . . . , SCn in the write period can be lowered, the voltage Vscn received by the power supply terminal V10 can be decreased.

(b) Utilizing Method

Figure 13:
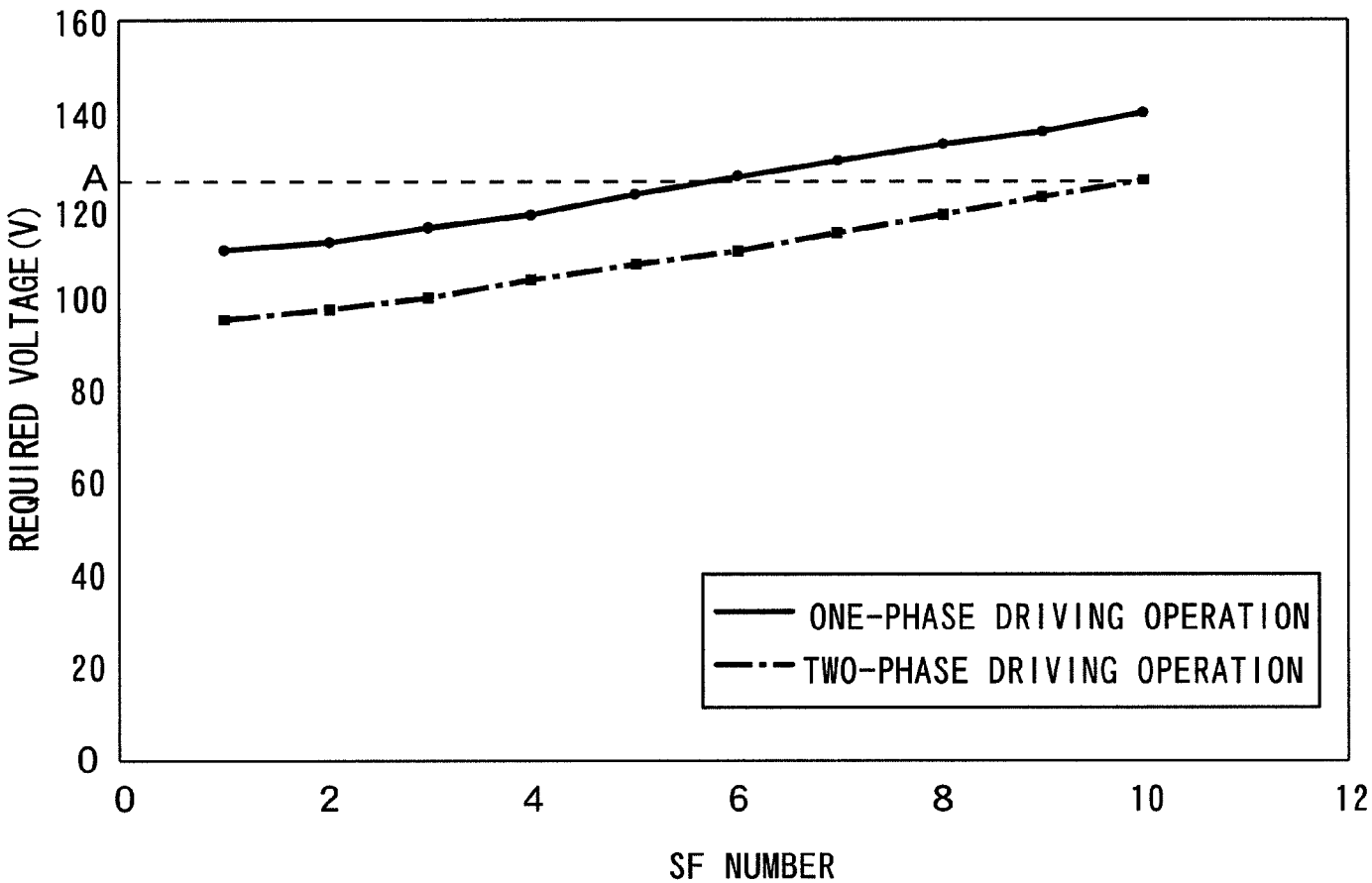
FIG. 13 is a diagram showing values of a voltage Vscn required for normal lighting of each discharge cell in each sub-field.

FIG. 13 is a diagram showing values of the voltage Vscn (hereinafter referred to as the required voltages) required for normal lighting of all the discharge cells (for generating the write discharges and the sustain discharges) in each sub-field. Note that the voltage Vscn (the required voltage) is a voltage supplied to the power supply terminal V10 of FIG. 5. In FIG. 13, the ordinate represents the required voltage, and the abscissa represents the sub-field number. Note that the first to tenth SFs have the luminance weights of 1, 2, 3, 6, 11, 18, 30, 44, 60 and 81, respectively. The solid line indicates the required voltage when the scan electrodes SC1 to SCn are driven by the one-phase driving operation, and the one-dot and dash line indicates the required voltage when the scan electrodes SC1 to SCn are driven by the two-phase driving operation.

As shown in FIG. 13, the required voltage for driving the scan electrodes SC1 to SCn by the two-phase driving operation is significantly lower than that for driving the scan electrodes SC1 to SCn by the one-phase driving operation. In addition, the required voltage becomes higher with increasing the luminance weight of the sub-field.

Here, in the example of FIG. 13, the required voltage for normal lighting of the discharge cells by the two-phase driving operation (hereinafter referred to as the required voltage for the two-phase drive) in the tenth SF is higher than the required voltage for normal lighting of the discharge cells by the one-phase driving operation in the fifth SF. In this case, the discharge cells can be normally lit by the one-phase driving operation in the first to fifth SFs if the required voltage for the two-phase drive can be supplied to the power supply terminal V10 (FIG. 6). Note that the required voltage for the two-phase drive is indicated by A in the ordinate of FIG. 13.

Accordingly, the voltage Vscn supplied to the power supply terminal V10 (FIG. 6) may not be set higher than the required voltage for the two-phase drive in the case of lighting the discharge cells by the one-phase driving operation in the first to fifth SFs and lighting the discharge cells by the two-phase driving operation in the sixth to tenth SFs. Thus, the voltage Vscn can be significantly decreased as compared with a case where the discharge cells are lit by the one-phase driving operation in the first to tenth SFs.

In this manner, the discharge cells are lit by the one-phase driving operation in the sub-fields in which the required voltage for normal lighting of the discharge cells by the one-phase driving operation is not more than the required voltage for the two-phase drive, and the discharge cells are lit by the two-phase driving operation in the other sub-fields in the present embodiment. Accordingly, the voltage Vscn required for normal lighting of the discharge cells can be efficiently decreased.

(1-7) Effects of the First Embodiment

As described above, the discharge cells are lit by the two-phase driving operation in the sub-fields in which the required voltage for normal lighting of the discharge cells by the one-phase driving operation is not less than the required voltage for the two-phase drive in the present embodiment. This allows the voltage Vscn to be sufficiently decreased.

In addition, the weak discharge for setup is not generated in the setup period in each discharge cell of the second discharge cell group in the two-phase driving operation. Therefore, the sufficient amount of charges can be stored in each discharge cell of the second discharge cell group at the starting time point of the write period. Accordingly, the discharge failures to be caused by the decrease of the wall charges can be prevented in the second discharge cell group.

In addition, the weak discharges are generated in predetermined discharge cells of the second discharge cell group after the application of the scan pulse Pa to the first discharge cell group is finished in the write period. Thus, each discharge cell of the second discharge cell group can be made suitable for the write operation immediately before the application of the scan pulse Pa to each discharge cell of the second discharge cell group. As a result, the discharge failure to be caused by the decrease of the wall charges can be reliably prevented from occurring in each discharge cell of the second discharge cell group.

Moreover, the sufficient amount of charges can remain in each discharge cell even though the potential (−Vad+Vscn) of the scan electrodes SC2, SC4, . . . , SCn (the second discharge cell group) is lowered to decrease the wall charges in each discharge cells of the second discharge cell group in the write period (excluding the period where the scan pulse Pa is applied). Accordingly, since the potential of the scan electrodes SC2, SC4, . . . , SCn can be lowered in the write period, the voltage Vscn received by the power supply terminal V10 can be decreased.

As a result, the voltage Vscn can be efficiently decreased and the discharge cells can be reliably lit. This reduces cost for driving the panel 10 and improves the operation performance thereof.

In the present embodiment, a potential difference between the node N1 and the node N3 is held constant by the DC power supply 200. Furthermore, the scan electrodes SC1, SC3, . . . , SCn−1 are selectively connected to the node N1 or the node N2 through the transistors Q1, Q2, and the scan electrodes SC2, SC4, . . . , SCn are selectively connected to the node N1 or the node N2 through the transistors Q101, Q102. Thus, the common or different driving waveforms are applied to the scan electrodes SC1, SC3, . . . , SCn−1 and the scan electrodes SC2, SC4, . . . , SCn. In this manner, the common or different driving waveforms can be easily applied to the scan electrodes SC1, SC3, . . . , SCn−1 and the scan electrodes SC2, SC4, . . . , SCn without causing the configuration and operation of the scan electrode driving circuit 53 to be complicated. This reduces manufacturing cost of the scan electrode driving circuit 53.

(2) Second Embodiment

Figure 14:
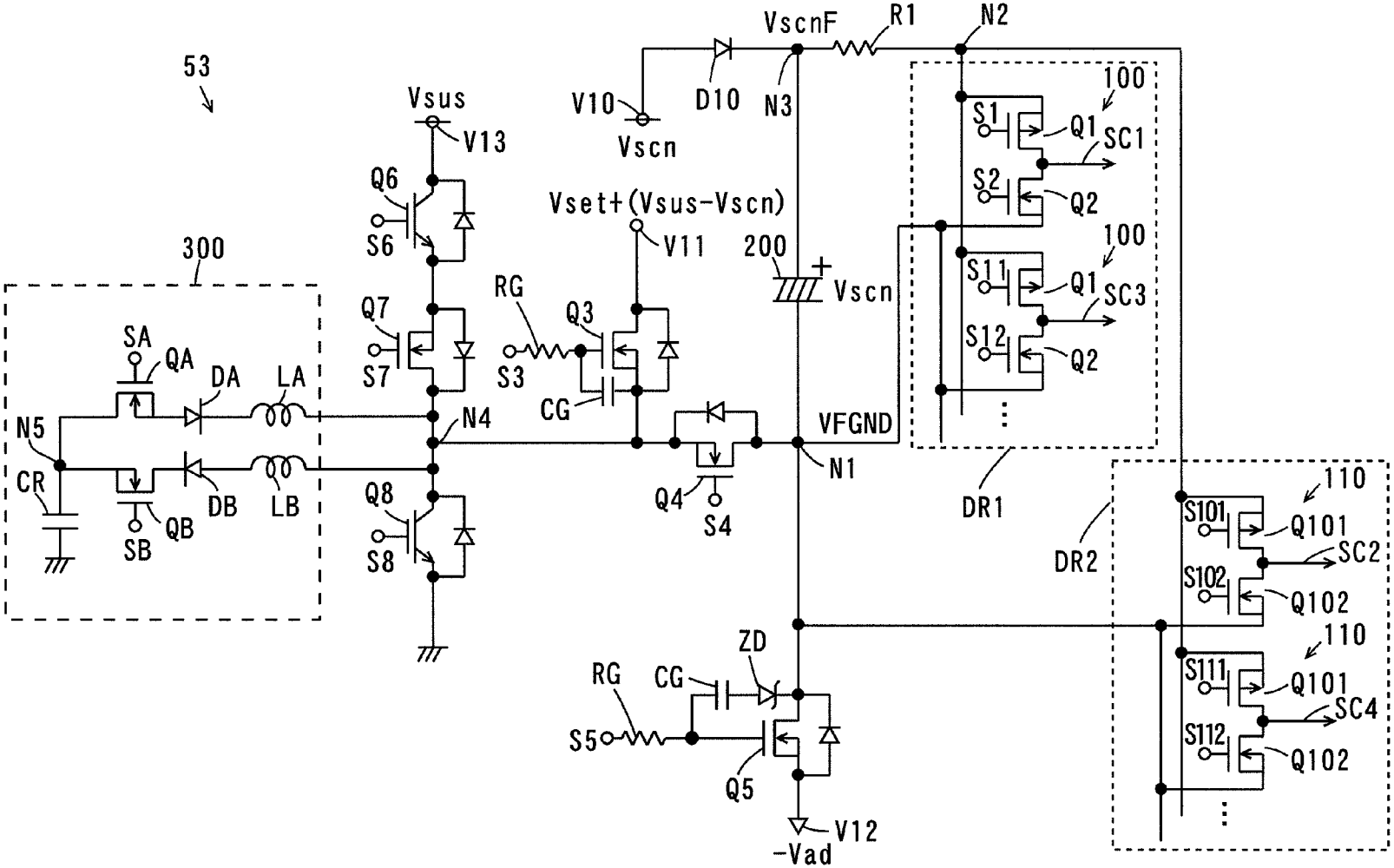
FIG. 14 is a circuit diagram showing the configuration of a scan electrode driving circuit according to a second embodiment.

FIG. 14 is a circuit diagram showing the configuration of the scan electrode driving circuit 53 according to a second embodiment. The scan electrode driving circuit 53 shown in FIG. 14 is different from the scan electrode driving circuit 53 of FIG. 6 in the following points.

As shown in FIG. 14, a zener diode ZD is connected between the gate of the transistor Q5 and the node N1 in the present embodiment.

Figure 15:
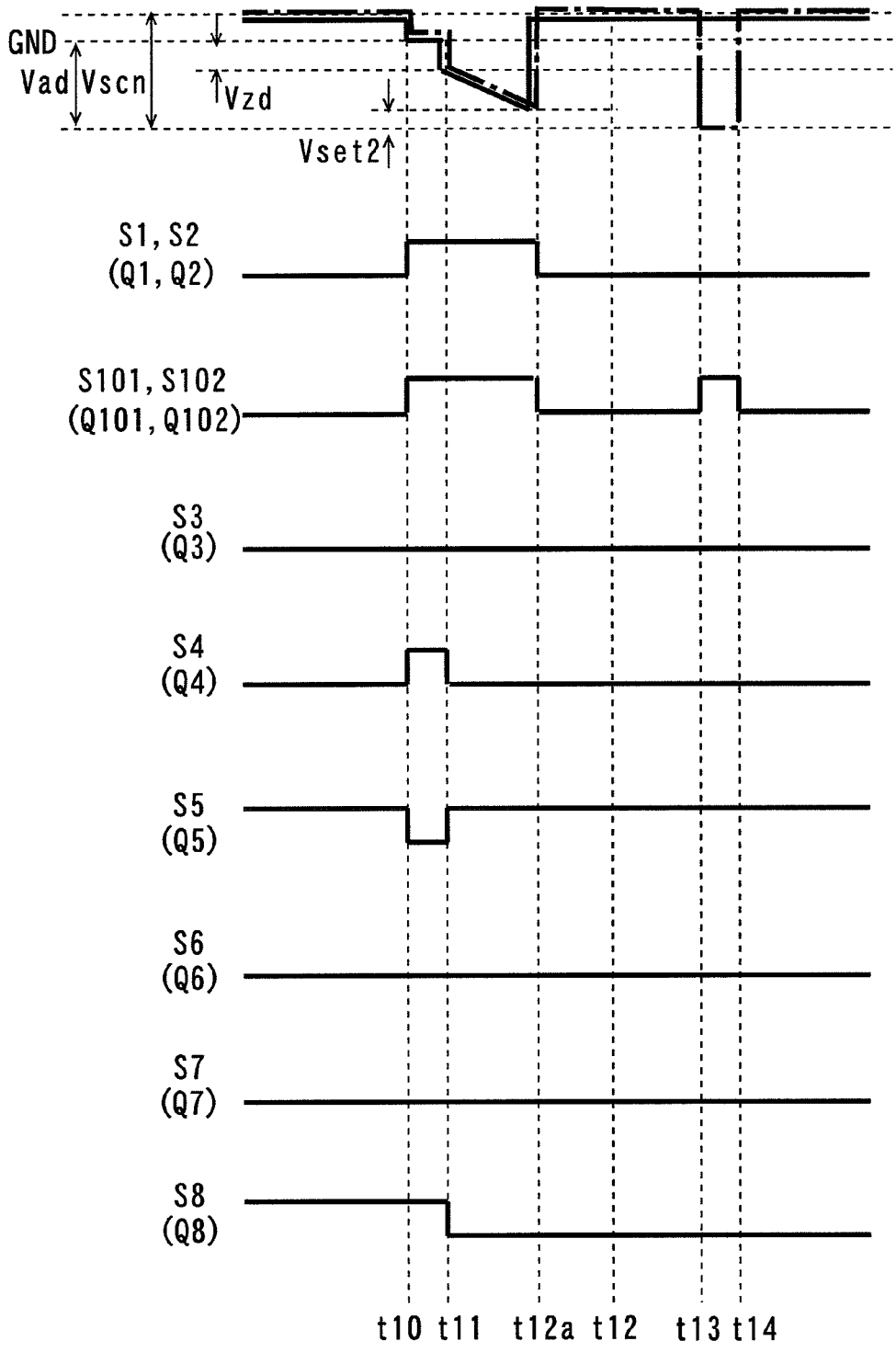
FIG. 15 is a detailed timing chart of the control signals applied to the transistors in the two-phase driving operation of the scan electrode driving circuit according to the second embodiment.

FIG. 15 is a detailed timing chart of the control signals applied to the transistors Q1 to Q8 in the write period of the first SF in the two-phase driving operation of the scan electrode driving circuit 53 according to the present embodiment. Change of the potential of the scan electrode SC1 is indicated by the solid line, and change of the potential of the scan electrode SC2 is indicated by the one-dot and dash line at the top stage of FIG. 15. Note that FIG. 15 shows the timing chart of a period corresponding to a period from the time point t10 to the time point t14 of FIG. 8.

The timing chart of FIG. 15 is different from the timing chart of FIG. 8 in the following points. As shown in FIG. 15, the scan electrodes SC1, SC2 drop from the ground potential by a zener voltage Vzd when the control signal S5 attains a high level and the transistor Q5 is turned on at the time point t11 in the present embodiment. After that, the potentials of the scan electrodes SC1, SC2 gradually drop from (−Vzd) toward (−Vad).

In this case, the potentials of the scan electrodes SC1, SC2 reach (−Vad) at a time point tl2*a* that is earlier than the time point t12. Thus, according to the present embodiment, the time required for applying the ramp waveforms to the scan electrodes SC1, SC2 can be shortened as compared with that in the first embodiment shown in FIG. 8. Accordingly, sufficient time for applying the sustain pulse can be ensured. This results in sufficiently improved luminance of the panel 10.

Note that the zener voltage Vzd is preferably set to a voltage of not more than the voltage Vad. In this case, the voltage at the intersection of the data electrode Dk and the scan electrode SC2 can be prevented from exceeding the discharge start voltage in each discharge cell of the second discharge cell group. Accordingly, the time required for the setup of the second discharge cells can be shortened, and the setup of the second discharge cell group can be reliably performed.

More preferably, the zener voltage Vzd is optimally set according to characteristics of the panel 10. Thus, the sustain period of a maximum length can be ensured to allow the maximum number of the sustain pulses Ps to be applied.

While description is made of the effects of providing the zener diode ZD in the foregoing paragraphs while taking the time of the application of the ramp waveform L6 (FIG. 5) as an example, the same effects can be obtained at the time of the application of the ramp waveform L8 to the scan electrodes SC1 to SCn in the write periods of the second SF and the subsequent SFs.

(3) Third Embodiment

In a third embodiment, the scan electrode driving circuit 53 can selectively perform the one-phase driving operation, the two-phase driving operation and a three-phase driving operation: the same driving waveforms for the setup discharges are applied to all the scan electrodes SC1 to SCn in the one-phase driving operation; the different driving waveforms for the setup discharges are applied to the scan electrodes SC1, SC3, . . . , SCn−1 and the scan electrodes SC2, SC4, . . . , SCn in the two-phase driving operation; and different driving waveforms for setup discharges are applied to the scan electrodes SC1, SC4, . . . , SCn−2, the scan electrodes SC2, SC5, . . . , SCn−1 and the scan electrodes SC3, SC6, . . . , SCn in the three-phase driving operation. Here, n is a multiple of three. Note that the same scan ICs as the scan IC 100 or the scan IC 110 are connected to the scan electrodes SC3, SC6, . . . , SCn. In the following description, the scan electrodes SC3, SC6, . . . , SCn are referred to as a third scan electrode group.

Figure 16:
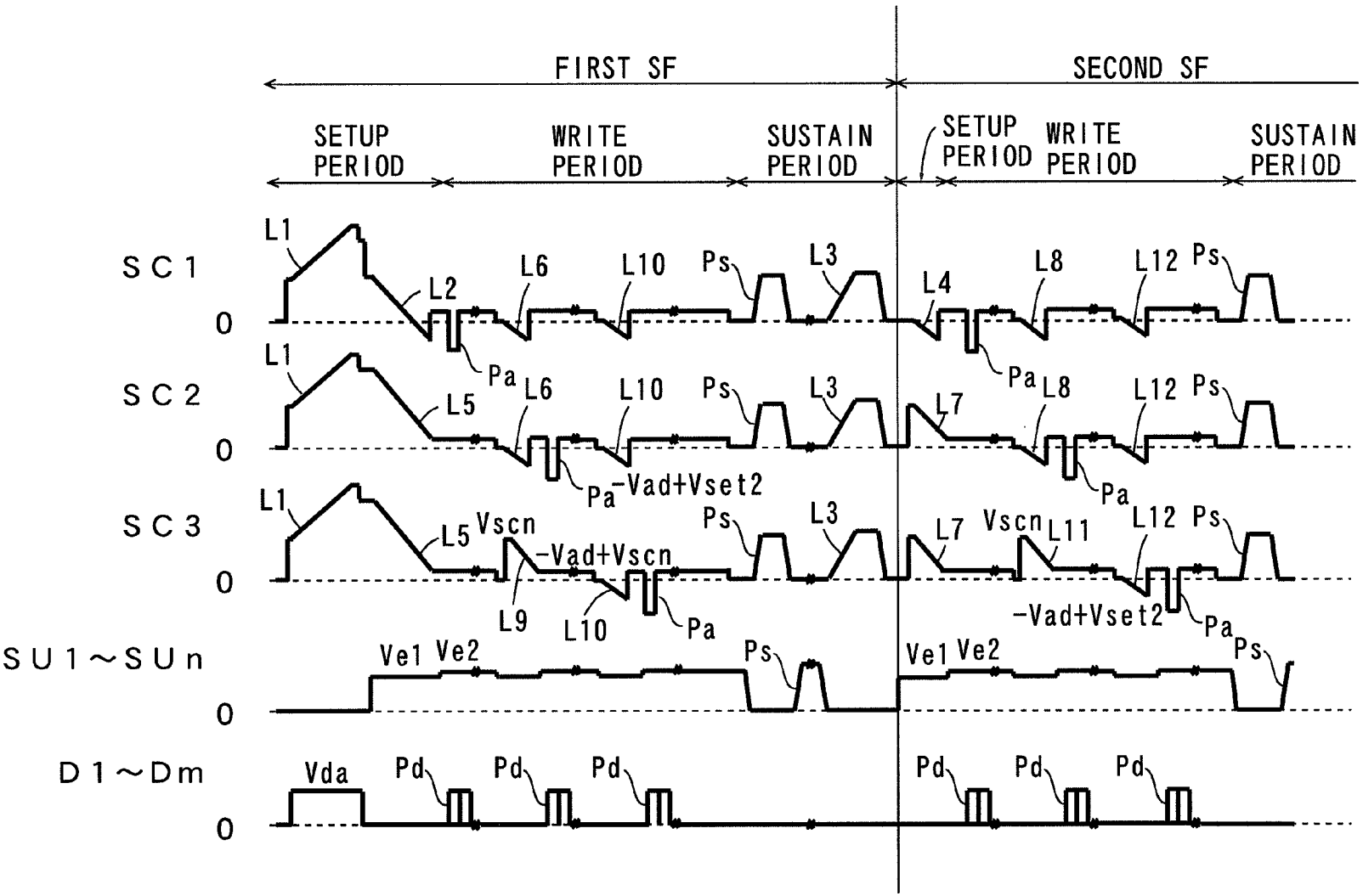
FIG. 16 is a detailed timing chart of the control signals applied to the transistors in a three-phase driving operation of the scan electrode driving circuit.

FIG. 16 shows the driving waveforms applied to the respective electrodes in the three-phase driving operation of the scan electrode driving circuit 53. Note that FIG. 16 shows the driving waveforms of the one scan electrode SC1 of the first scan electrode group, the one scan electrode SC2 of the second scan electrode group, the one scan electrode SC3 of the third scan electrode group, the sustain electrodes SU1 to SUn and the data electrodes D1 to Dm. The period from the setup period of the first SF to the sustain period of the second SF of one field is shown in FIG. 16. The ramp waveforms L1 to L8 shown in FIG. 16 are the same as those of FIGS. 4 and 5.

Note that in the following description, the discharge cells on the first scan electrode group are referred to as the first discharge cell group, the discharge cells on the second scan electrode group are referred to as the second discharge cell group, and the discharge cells on the third scan electrode group are referred to as a third discharge cell group.

The ramp waveforms L1, L2 are applied to the first scan electrode group in the setup period of the first SF. This generates two weak setup discharges in each discharge cell of the first discharge cell group. As a result, the amount of the wall charges in each discharge cell of the first discharge cell group is adjusted to be suitable for the write operation.

Meanwhile, the ramp waveforms L1, L5 are applied to the second and third scan electrode groups. In this case, the second weak setup discharge is not generated in each discharge cell of the second and third discharge cell groups. Accordingly, the sufficient amount of wall charges can be held in each discharge cell of the second and third discharge cell groups.

In the write period, the scan pulse Pa is sequentially applied to the scan electrodes SC1, SC4, . . . , SCn−2 of the first scan electrode group. This generates the write discharges in the selected discharge cells of the first discharge cell group.

After the scan pulse Pa is applied to the first scan electrode group, the ramp waveform L6 is applied to the first and second scan electrode groups. This generates the second weak setup discharge in each discharge cell of the second discharge cell group. As a result, the amount of the wall charges of each discharge cell of the second discharge cell group is adjusted to be suitable for the write operation.

Meanwhile, a ramp waveform L9 that is the same as the ramp waveform L7 of FIG. 4 is applied to the third scan electrode group after the application of the potential Vscn. In this case, the second weak setup discharge is not generated in each discharge cell of the third discharge cell group. Accordingly, the sufficient amount of wall charges can be held in each discharge cell of the third discharge cell group.

After the ramp waveform L6 is applied to the first and second scan electrode groups, the scan pulse Pa is sequentially applied to the scan electrodes SC2, SC5, . . . , SCn−1 of the second scan electrode group. This generates the write discharges in the selected discharge cells of the second discharge cell group.

The scan pulse Pa is applied to the second scan electrode group, and then a ramp waveform L10 that is the same as the ramp waveform L6 is applied to each of the scan electrodes SC1 to SCn. This generates the second weak setup discharge in each discharge cell of the third discharge cell group. As a result, the amount of the wall charges in each discharge cell of the third discharge cell group is adjusted to be suitable for the write operation.

Thereafter, the scan pulse Pa is sequentially applied to the scan electrodes SC3, SC6, . . . , SCn of the third discharge cell group. This generates the write discharges in the selected discharge cells of the third discharge cell group.

The ramp waveform L4 is applied to the first scan electrode group in the setup period of the second SF. Thus, the weak setup discharges are generated in the discharge cells of the first discharge cell group in which the sustain discharges have been induced in the sustain period of the preceding sub-field (the first SF in FIG. 11). As a result, the amount of the wall charges in each discharge cell of the first discharge cell group is adjusted to be suitable for the write operation.

Meanwhile, the ramp waveform L7 is applied to the second and third scan electrode groups after the application of the potential Vscn. In this case, the weak setup discharge is not generated in each discharge cell of the second and third discharge cell groups. Accordingly, the sufficient amount of wall charges can be held in each discharge cell of the second and third discharge cell groups.

In the write period, the scan pulse Pa is sequentially applied to the scan electrodes SC1, SC4, . . . , SCn−2 of the first scan electrode group. This generates the write discharge in the selected discharge cells of the first discharge cell group.

The ramp waveform L8 is applied to the first and second scan electrode groups after the application of the scan pulse Pa to the first scan electrode group. This generates the weak setup discharge in each discharge cell of the second discharge cell group. As a result, the amount of the wall charges of each discharge cell of the second discharge cell group is adjusted to be suitable for the write operation.

Meanwhile, a ramp waveform L11 that is the same as the ramp waveform L7 is applied to the third scan electrode group after the application of the potential Vscn. In this case, the weak setup discharge is not generated in each discharge cell of the third discharge cell group. Accordingly, the sufficient amount of wall charges can be held in each discharge cell of the third discharge cell group.

After the ramp waveform L8 is applied to the first and second scan electrode groups, the scan pulse Pa is sequentially applied to the scan electrodes SC2, SC5, . . . , SCn−1 of the second scan electrode group. This generates the write discharges in the selected discharge cells of the second discharge cell group.

After the scan pulse Pa is applied to the second scan electrode group, a ramp waveform L12 that is the same as the ramp waveform L8 is applied to the scan electrodes SC1 to SCn. Thus, the weak setup discharge is generated in each discharge cell of the third discharge cell group. As a result, the amount of the wall charges of each discharge cell of the third discharge cell group can be adjusted to be suitable for the write operation.

Thereafter, the scan pulse Pa is sequentially applied to the scan electrodes SC3, SC6, . . . , SCn of the third discharge cell group. This generates the write discharges in the selected discharge cells of the third discharge cell group.

As described above, in the three-phase driving operation, the weak discharge for setup (the second weak discharge in the first SF) is not generated in the setup period in each discharge cell of the second discharge cell group. Therefore, the sufficient amount of charges can be stored in each discharge cell of the second discharge cell group at the starting time point of the write period.

In this case, the occurrence of the discharge failures to be caused by the decrease of the wall charges in the second discharge cell group can be prevented even though the wall charges stored in each discharge cell are decreased by the time when the scan pulse Pa is applied to each discharge cell of the second discharge cell group.

In addition, the weak discharge for setup (the second weak discharge in the first SF) is not generated until the application of the scan pulse Pa to the first and second discharge cell groups is finished in the write period in each discharge cell of the third discharge cell group.

In this case, the occurrence of the discharge failures to be caused by the decrease of the wall charges in the third discharge cell group can be prevented even though the wall charges stored in each discharge cell are decreased by the time when the scan pulse Pa is applied to each discharge cell of the third discharge cell group.

As a result, the discharge failure can be reliably prevented from occurring in each discharge cell. Moreover, the sufficient amount of charges can remain in each discharge cell even though the potential (−Vad+Vscn) of the second and third scan electrode groups is lowered to decrease the wall charges in each discharge cell of the second and third discharge cell groups in the write period (excluding the periods where the scan pulses Pa are applied). Since the potential of the second and third scan electrode groups in the write period can be lowered, the voltage Vscn received by the power supply terminal V10 can be decreased.

Figure 17:
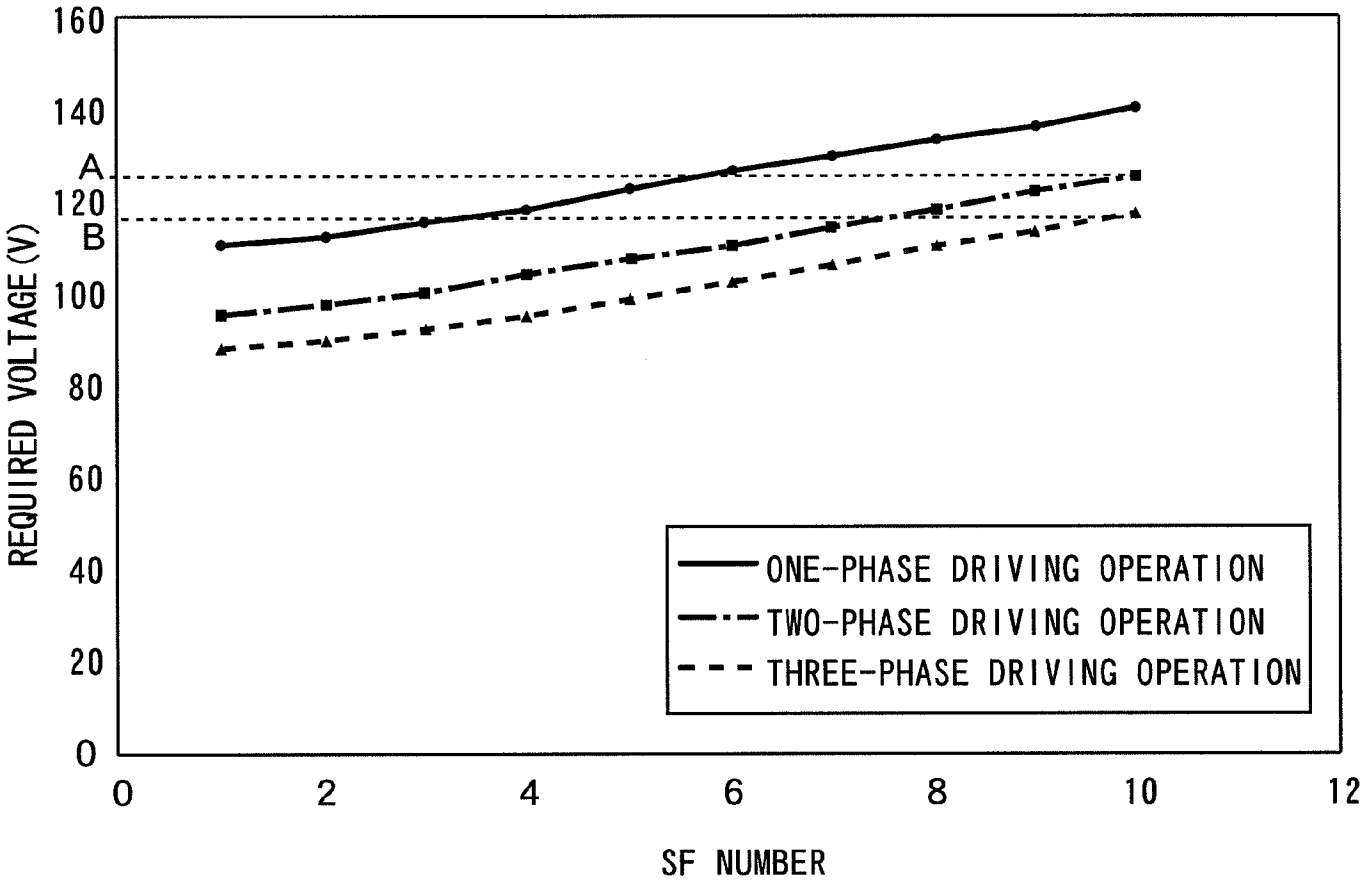
FIG. 17 is a diagram showing required voltages in each sub-field.

FIG. 17 is a diagram showing required voltages in each sub-field. In FIG. 17, the ordinate represents the required voltage, and the abscissa represents the sub-field number. Note that the first to tenth SFs have the luminance weights of 1, 2, 3, 6, 11, 18, 30, 44, 60 and 81, respectively. The solid line indicates the required voltage when the scan electrodes SC1 to SCn are driven by the one-phase driving operation, the one-dot and dash line indicates the required voltage when the scan electrodes SC1 to SCn are driven by the two-phase driving operation, and the broken line indicates the required voltage when the scan electrodes SC1 to SCn are driven by the three-phase driving operation. Note that the solid line and the one-dot and dash line of FIG. 17 indicate the same values as those indicated by the solid line and the one-dot and dash line of FIG. 13, respectively.

As shown in FIG. 17, the required voltage for driving the scan electrodes SC1 to SCn by the three-phase driving operation is significantly lower than that for driving the scan electrodes SC1 to SCn by the one-phase driving operation and the two-phase driving operation. In addition, the required voltage becomes higher with increasing the luminance weight of the sub-field.

Here, in the example of FIG. 17, the required voltage for normal lighting of the discharge cells by the three-phase driving operation (hereinafter referred to as the required voltage for the three-phase drive) in the tenth SF is higher than the required voltage for normal lighting of the discharge cells by the two-phase driving operation in the fifth SF. In this case, the discharge cells can be normally lit by the two-phase driving operation in the first to seventh SFs if the required voltage for the three-phase drive can be supplied to the power supply terminal V10 (FIG. 6). Note that the required voltage for the three-phase drive is indicated by B in the ordinate of FIG. 17.

In addition, the required voltage for the three-phase drive is higher than the required voltage for lighting of the discharge cells by the one-phase driving operation in the third SF. In this case, the discharge cells can be normally lit by the two-phase driving operation in the first to third SFs if the required voltage for the three-phase drive can be supplied to the power supply terminal V10 (FIG. 6).

Accordingly, the voltage Vscn supplied to the power supply terminal V10 (FIG. 6) may not be set higher than the required voltage for the three-phase drive in the case of lighting the discharge cells by the one-phase driving operation in the first to third SFs, lighting the discharge cells by the two-phase driving operation in the fourth to seventh SFs and lighting the discharge cells by the three-phase driving operation in the eighth to tenth SFs. Accordingly, the voltage Vscn can be significantly decreased as compared with a case where the discharge cells are lit by the one-phase driving operation and the two-phase driving operation in the first to tenth SFs.

In this manner, the discharge cells are lit by the one-phase driving operation in the sub-fields in which the required voltage for normal lighting of the discharge cells by the one-phase driving operation is not more than the required voltage for the three-phase drive, the discharge cells are lit by the two-phase driving operation in the sub-fields in which the required voltage for normal lighting of the discharge cells by the two-phase driving operation is not more than the required voltage for the three-phase drive, and the discharge cells are lit by the three-phase driving operation in the other sub-fields in the present embodiment. Accordingly, the voltage Vscn required for normal lighting of the discharge cells can be efficiently decreased.

(4) Other Embodiments

While the n-channel FET and the p-channel FET are used as the switching devices in the scan electrode driving circuit 53 in the foregoing embodiments, the switching devices are not limited to the foregoing examples.

For example, a p-channel FET, an IGBT (Insulated Gate Bipolar Transistor) or the like may be employed instead of the n-channel FET, and an n-channel FET, an IGBT (Insulated Gate Bipolar Transistor) or the like may be employed instead of the p-channel FET in each of the above-described circuits.

While the setup operation for all the cells is performed in the first SF in the foregoing embodiments, the selective setup operation may be performed in the first SF and the setup operation for all the cells may be performed in any SF of the second SF and the subsequent SFs.

While the scan electrodes SC1, SC3, . . . , SCn−1 are referred to as the first scan electrode group and the scan electrodes SC2, SC4, . . . , SCn are referred to as the second scan electrode group in the first and second embodiments, the scan electrodes SC1 to SCn/2 may be referred to as the first scan electrode group, and the scan electrodes SCn/2+1 to SCn may be referred to as the first scan electrode group. In this case, the sustain electrodes SU1 to SUn/2 are referred to as the first sustain electrode group, and the sustain electrodes SUn/2+1 to SUn are referred to as the second sustain electrode group.

While the scan electrodes SC1, SC4, . . . , SCn−2 are referred to as the first scan electrode group, the scan electrodes SC2, SC5, . . . , SCn−1 are referred to as the second scan electrode group, and the scan electrodes SC3, SC6, . . . , SCn are referred to as the third scan electrode group in the third embodiment, the scan electrodes SC1 to SCn/3 may be referred to as the first scan electrode group, the scan electrodes SCn/3+1 to SC2*n*/3 may be referred to as the second scan electrode group, and the scan electrodes SC2*n*/3+1 to SCn may be referred to as the third scan electrode group.

While the scan electrodes SC1 to SCn are divided into the first and second scan electrode groups or the first to third scan electrode groups and all the discharge cells of the panel 10 are divided into the first and second discharge cell groups or the first to third discharge cell groups in the foregoing embodiments, the scan electrodes SC1 to SCn may be divided into four or more scan electrode groups and all the discharge cells of the panel 10 may be divided into four or more discharge cell groups.

While the ramp waveforms L6, L8 (FIG. 5) are applied to the first scan electrode group (the scan electrodes SC1, SC3, . . . , SCn−1) in the first and second embodiments, the ramp waveforms L6, L8 may not be applied to the first scan electrode group.

While the ramp waveforms L6, L8, L10, L12 (FIG. 16) are applied to the first scan electrode group (the scan electrodes SC1, SC4, . . . , SCn−2) in the third embodiment, the ramp waveforms L6, L8, L10, L12 may not be applied to the first scan electrode group. While the ramp waveforms L10, L12 (FIG. 16) are applied to the second scan electrode group (the scan electrodes SC2, SC5, . . . , SCn−1), the ramp waveforms L10, L12 may not be applied to the second scan electrode group.

While the tenth SF has the largest luminance weight in the foregoing embodiments, another SF may have the largest luminance weight. In this case, the required voltage for normal lighting of the discharge cells by the two-phase driving operation in the another SF is the required voltage for the two-phase drive, and the required voltage for normal lighting of the discharge cells by the three-phase driving operation in the another SF is the required voltage for the three-phase drive.

(5) Correspondences between Elements in the Claims and Parts in Embodiments

In the following paragraphs, non-limiting examples of correspondences between various elements recited in the claims below and those described above with respect to various preferred embodiments of the present invention are explained.

In the foregoing embodiments, the scan electrodes SC1, SC3, . . . , SCn−1 or the scan electrodes SC1, SC4, . . . , SCn−2 are examples of a plurality of first scan electrodes, the scan electrodes SC2, SC4, . . . , SCn or the scan electrodes SC2, SC5, . . . , SCn−1 are examples of a plurality of second scan electrodes, the scan electrodes SC3, SC6, . . . , SCn are examples of a plurality of third scan electrodes, the power supply terminal V10 is an example of a voltage source, and the scan electrode driving circuit 53 is an example of a driving circuit.

The potential Vsus and the ground potential are examples of a first potential, the potential (−Vad+Vset2) is an example of a second potential, the ramp waveform L2 and the ramp waveform L4 are examples of a first ramp waveform, the potential (Vsus+Vscn) and the potential Vscn are examples of a third potential, the potential (−Vad+Vscn) is an example of a fourth potential, and the ramp waveform L5 and the ramp waveform L7 are examples of a second ramp waveform.

The ground potential is an example of a fifth potential, the potential (−Vad+Vset2) is an example of a sixth potential, the ramp waveform L6 and the ramp waveform L8 are examples of a third ramp waveform, the ramp waveform L2 and the ramp waveform L4 are examples of a common driving waveform, and 30 or 6 is an example of a first luminance weight.

The potential Vsus and the ground potential are examples of a seventh potential, the potential (−Vad+Vset2) is an example of an eighth potential, the ramp waveform L2 and the ramp waveform L4 are examples of a fourth ramp waveform, the potential (Vsus+Vscn) and the potential Vscn are examples of a ninth potential, the potential (−Vad+Vscn) is an example of a tenth potential, the ramp waveform L5 and the ramp waveform L7 are examples of a fifth ramp waveform.

The ground potential is an example of eleventh and thirteenth potential, the potential (−Vad+Vset2) is an example of twelfth and fourteenth potentials, the ramp waveform L6 and the ramp waveform L8 are examples of a sixth ramp waveform, the ramp waveform L10 and the ramp waveform L12 are examples of a seventh ramp waveform, the ramp waveform L2 and the ramp waveform L4 are examples of a common driving waveform, and 44 is an example of a second luminance weight.

As each of various elements recited in the claims, various other elements having configurations or functions described in the claims can be also used.

[Industrial Applicability]

The present invention is applicable to a display apparatus that displays various images.

The invention claimed is:

1. A driving device that drives a plasma display panel including discharge cells at intersections of a plurality of scan electrodes, a plurality of sustain electrodes and a plurality of data electrodes by a sub-field method in which one field period includes a plurality of sub-fields having respective luminance weights, comprising:

a voltage source that generates a driving voltage; and a driving circuit that performs a two-phase driving operation to said plurality of scan electrodes in at least a sub-field having a largest luminance weight of said plurality of sub-fields using the driving voltage generated by said voltage source, wherein said driving circuit applies a first ramp waveform that drops from a first potential to a second potential to a plurality of first scan electrodes of said plurality of scan electrodes and applies a second ramp waveform that drops from a third potential that is higher than said first potential to a fourth potential that is higher than said second potential to a plurality of second scan electrodes of said plurality of scan electrodes in a setup period, and sequentially applies a scan pulse to said plurality of first scan electrodes and sequentially applies a scan pulse to said plurality of second scan electrodes after the scan pulse is applied to said plurality of first scan electrodes in a write period in said two-phase driving operation.

2. The driving device of the plasma display panel according to claim 1, wherein said driving circuit applies a third ramp waveform that drops from a fifth potential to a sixth potential to said plurality of second scan electrodes after the scan pulse is applied to said plurality of first scan electrodes and before the scan pulse is applied to said plurality of second scan electrodes in the write period of at least said sub-field having the largest luminance weight.

3. The driving device of the plasma display panel according to claim 2, wherein said driving circuit performs a one-phase driving operation in which a common driving waveform is applied to said plurality of scan electrodes in a setup period of at least one sub-field, which is not at least said sub-field having the largest luminance weight, of said plurality of sub-fields.

4. The driving device of the plasma display panel according to claim 3, wherein said driving circuit performs said two-phase driving operation in a sub-field having a luminance weight of not less than a first luminance weight of said plurality of sub-fields, and performs said one-phase driving operation in a sub-field having a luminance weight that is smaller than said first luminance weight.

5. The driving device of the plasma display panel according to claim 4, wherein the sub-field having the luminance weight of not less than said first luminance weight is set such that selected discharge cells are not normally lit in a case where said plurality of scan electrodes are driven by said one-phase driving operation in the sub-field, and the selected discharge cells are normally lit in a case where said plurality of scan electrodes are driven by said two-phase driving operation in the sub-field.

6. A driving device that drives a plasma display panel including discharge cells at intersections of a plurality of scan electrodes, a plurality of sustain electrodes and a plurality of data electrodes by a sub-field method in which one field period includes a plurality of sub-fields having respective luminance weights, comprising:

a voltage source that generates a driving voltage; and a driving circuit that performs a three-phase driving operation to said plurality of scan electrodes in at least a sub-field having a largest luminance weight of said plurality of sub-fields and performs a two-phase driving operation to said plurality of scan electrodes in at least one sub-field, which is not at least said sub-field having the largest luminance weight, using the driving voltage generated by said voltage source, wherein said driving circuit applies a first ramp waveform that drops from a first potential to a second potential to a plurality of first scan electrodes of said plurality of scan electrodes, applies a second ramp waveform that drops from a third potential that is higher than said first potential to a fourth potential that is higher than said second potential to a plurality of second scan electrodes of said plurality of scan electrodes in a setup period, sequentially applies a scan pulse to said plurality of first scan electrodes, applies a third ramp waveform that drops from a fifth potential to a sixth potential to said plurality of second scan electrodes after the scan pulse is applied to said plurality of first scan electrodes, and sequentially applies a scan pulse to said plurality of second scan electrodes after said third ramp waveform is applied to said plurality of second scan electrodes in a write period in said two-phase driving operation, and applies a fourth ramp waveform that drops from a seventh potential to an eighth potential to a plurality of third scan electrodes of said plurality of scan electrodes, and applies a fifth ramp waveform that drops from a ninth potential that is higher than said seventh potential to a tenth potential that is higher than said eighth potential to a plurality of fourth scan electrodes and a plurality of fifth scan electrodes of said plurality of scan electrodes in said setup period, and sequentially applies a scan pulse to said plurality of third scan electrodes, applies a sixth ramp waveform that drops from an eleventh potential to a twelfth potential to said plurality of fourth scan electrodes after the scan pulse is applied to said plurality of third scan electrodes, sequentially applies a scan pulse to said plurality of fourth scan electrodes after said sixth ramp waveform is applied to said plurality of fourth scan electrodes, applies a seventh ramp waveform that drops from a thirteenth potential to a fourteenth potential to said plurality of fifth scan electrodes after the scan pulse is applied to said plurality of fourth scan electrodes, and sequentially applies a scan pulse to said plurality of fifth scan electrodes after said seventh ramp waveform is applied to said plurality of fifth scan electrodes in the write period in said three-phase driving operation.

7. A driving method of a plasma display panel including discharge cells at intersections of a plurality of scan electrodes, a plurality of sustain electrodes and a plurality of data electrodes by a sub-field method in which one field period includes a plurality of sub-fields having respective luminance weights, comprising the step of performing a two-phase driving operation to said plurality of scan electrodes in at least a sub-field having a largest luminance weight of said plurality of sub-fields, wherein said two-phase driving operation includes the steps of applying a first ramp waveform that drops from a first potential to a second potential to a plurality of first scan electrodes of said plurality of scan electrodes and applying a second ramp waveform that drops from a third potential that is higher than said first potential to a fourth potential that is higher than said second potential to a plurality of second scan electrodes of said plurality of scan electrodes in a setup period, and sequentially applying a scan pulse to said plurality of first scan electrodes and sequentially applies a scan pulse to said plurality of second scan electrodes after the scan pulse is applied to said plurality of first scan electrodes in a write period.

8. A driving method of a plasma display panel including discharge cells at intersections of a plurality of scan electrodes, a plurality of sustain electrodes and a plurality of data electrodes by a sub-field method in which one field period includes a plurality of sub-fields having respective luminance weights, comprising the steps of:

performing a three-phase driving operation to said plurality of scan electrodes in at least a sub-field having a largest luminance weight of said plurality of sub-fields; and performing a two-phase driving operation to said plurality of scan electrodes in at least one sub-field, which is not at least said sub-field having the largest luminance weight, wherein said two-phase driving operation includes the steps of applying a first ramp waveform that drops from a first potential to a second potential to a plurality of first scan electrodes of said plurality of scan electrodes, applying a second ramp waveform that drops from a third potential that is higher than said first potential to a fourth potential that is higher than said second potential to a plurality of second scan electrodes of said plurality of scan electrodes in a setup period, sequentially applying a scan pulse to said plurality of first scan electrodes, applying a third ramp waveform that drops from a fifth potential to a sixth potential to said plurality of second scan electrodes after the scan pulse is applied to said plurality of first scan electrodes, and sequentially applying a scan pulse to said plurality of second scan electrodes after said third ramp waveform is applied to said plurality of second scan electrodes in a write period, and said three-phase driving operation includes the steps of applying a fourth ramp waveform that drops from a seventh potential to an eighth potential to a plurality of third scan electrodes of said plurality of scan electrodes, and applying a fifth ramp waveform that drops from a ninth potential that is higher than said seventh potential to a tenth potential that is higher than said eighth potential to a plurality of fourth scan electrodes and a plurality of fifth scan electrodes of said plurality of scan electrodes in the setup period, and sequentially applying a scan pulse to said plurality of third scan electrodes, applying a sixth ramp waveform that drops from an eleventh potential to a twelfth potential to said plurality of fourth scan electrodes after the scan pulse is applied to said plurality of third scan electrodes, sequentially applying a scan pulse to said plurality of fourth scan electrodes after said sixth ramp waveform is applied to said plurality of fourth scan electrodes, applying a seventh ramp waveform that drops from a thirteenth potential to a fourteenth potential to said plurality of fifth scan electrodes after the scan pulse is applied to said plurality of fourth scan electrodes, and sequentially applying a scan pulse to said plurality of fifth scan electrodes after said seventh ramp waveform is applied to said plurality of fifth scan electrodes in the write period.

9. A plasma display panel apparatus comprising:

a plasma display panel including discharge cells at intersections of a plurality of scan electrodes, a plurality of sustain electrodes and a plurality of data electrodes; and a driving device that drives said plasma display panel by a sub-field method in which one field period includes a plurality of sub-fields having respective luminance weights, wherein said driving device includes a voltage source that generates a driving voltage, and a driving circuit that performs a two-phase driving operation to said plurality of scan electrodes in at least a sub-field having a largest luminance weight of said plurality of sub-fields using the driving voltage generated by said voltage source, and said driving circuit applies a first ramp waveform that drops from a first potential to a second potential to a plurality of first scan electrodes of said plurality of scan electrodes and applies a second ramp waveform that drops from a third potential that is higher than said first potential to a fourth potential that is higher than said second potential to a plurality of second scan electrodes of said plurality of scan electrodes in a setup period, and sequentially applies a scan pulse to said plurality of first scan electrodes and sequentially applies a scan pulse to said plurality of second scan electrodes after the scan pulse is applied to said plurality of first scan electrodes in a write period in said two-phase driving operation.

10. A plasma display panel apparatus comprising:

a plasma display panel including discharge cells at intersections of a plurality of scan electrodes, a plurality of sustain electrodes and a plurality of data electrodes; and a driving device that drives said plasma display panel by a sub-field method in which one field period includes a plurality of sub-fields having respective luminance weights, wherein said driving device includes a voltage source that generates a driving voltage; and a driving circuit that performs a three-phase driving operation to said plurality of scan electrodes in at least a sub-field having a largest luminance weight of said plurality of sub-fields and performs a two-phase driving operation to said plurality of scan electrodes in at least one sub-field, which is not at least said sub-field having the largest luminance weight, using the driving voltage generated by said voltage source, and said driving circuit applies a first ramp waveform that drops from a first potential to a second potential to a plurality of first scan electrodes of said plurality of scan electrodes, and applies a second ramp waveform that drops from a third potential that is higher than said first potential to a fourth potential that is higher than said second potential to a plurality of second scan electrodes of said plurality of scan electrodes in a setup period, sequentially applies a scan pulse to said plurality of first scan electrodes, applies a third ramp waveform that drops from a fifth potential to a sixth potential to said plurality of second scan electrodes after the scan pulse is applied to said plurality of first scan electrodes, and sequentially applies a scan pulse to said plurality of second scan electrodes after said third ramp waveform is applied to said plurality of second scan electrodes in a write period in said two-phase driving operation, and applies a fourth ramp waveform that drops from a seventh potential to an eighth potential to a plurality of third scan electrodes of said plurality of scan electrodes, and applies a fifth ramp waveform that drops from a ninth potential that is higher than said seventh potential to a tenth potential that is higher than said eighth potential to a plurality of fourth scan electrodes and a plurality of fifth scan electrodes of said plurality of scan electrodes in said setup period, sequentially applies a scan pulse to said plurality of third scan electrodes, applies a sixth ramp waveform that drops from an eleventh potential to a twelfth potential to said plurality of fourth scan electrodes after the scan pulse is applied to said plurality of third scan electrodes, sequentially applies a scan pulse to said plurality of fourth scan electrodes after said sixth ramp waveform is applied to said plurality of fourth scan electrodes, applies a seventh ramp waveform that drops from a thirteenth potential to a fourteenth potential to said plurality of fifth scan electrodes after the scan pulse is applied to said plurality of fourth scan electrodes, and sequentially applies a scan pulse to said plurality of fifth scan electrodes after said seventh ramp waveform is applied to said plurality of fifth scan electrodes in the write period in said three-phase driving operation.

* * * * *